US010690402B2

(12) United States Patent
Roesch et al.

(10) Patent No.: US 10,690,402 B2
(45) **Date of Patent: *Jun. 23, 2020**

(54) SHELF ASSEMBLY

(71) Applicant: Electrolux Home Products, Inc., Charlotte, NC (US)

(72) Inventors: Brian Roesch, Anderson, SC (US); Cory Dale Simpson, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/542,373

(22) Filed: Aug. 16, 2019

(65) Prior Publication Data

US 2019/0368807 A1 Dec. 5, 2019

Related U.S. Application Data

(63) Continuation of application No. 15/852,139, filed on Dec. 22, 2017.

(51) Int. Cl.
*F25D 25/02* (2006.01)

(52) U.S. Cl.
CPC ..... *F25D 25/027* (2013.01); *F25D 2325/022* (2013.01)

(58) Field of Classification Search
CPC ..... A47B 46/00; A47F 5/0037; F25D 25/027
USPC ..... 108/108, 124; 248/235; 211/153, 150, 211/149; 312/133, 135, 136, 408, 410, 312/300, 311, 351.9, 401
See application file for complete search history.

(56) References Cited

U.S. PATENT DOCUMENTS

| | | | |
|---|---|---|---|
| 4,923,260 | A | 5/1990 | Poulsen |
| D387,780 | S | 12/1997 | Sandlin et al. |
| 5,813,741 | A | 9/1998 | Fish et al. |
| 6,065,821 | A | 5/2000 | Anderson et al. |
| 6,182,330 | B1 | 2/2001 | Novin et al. |
| 6,474,094 | B2 | 11/2002 | Kim |
| 6,665,906 | B2 | 12/2003 | Li |
| 6,684,456 | B2 | 2/2004 | Lee |
| 7,062,817 | B2 | 6/2006 | Lee |
| 7,337,498 | B2 | 3/2008 | Hsieh |
| 7,506,608 | B2 | 3/2009 | Sato et al. |
| D612,404 | S | 3/2010 | Picken et al. |
| 8,262,177 | B2 | 9/2012 | Picken et al. |
| 8,376,483 | B2 | 2/2013 | Jung |
| 8,622,494 | B2 | 1/2014 | Picken et al. |
| 8,640,482 | B2 | 2/2014 | Lim et al. |

(Continued)

*Primary Examiner* — Jose V Chen
(74) *Attorney, Agent, or Firm* — Pearne & Gordon LLP

(57) ABSTRACT

A shelf assembly includes a rotating hinge body rotatably coupled to a stationary hinge body, and a shelf fixed to the rotating hinge body that is rotatable with the rotating hinge body relative to the stationary hinge body about a rotational axis. The shelf is rotatable between first and second positions. Moreover, the shelf assembly includes a cam assembly configured to inhibit rotation of the shelf between its first and second positions. The cam assembly includes a cam fixed to one of the stationary hinge body and rotating hinge body, a cam follower movably attached to the other of the stationary hinge body and rotating hinge body, and a biasing member that biases the cam follower into engagement with the cam. The rotatable shelf includes a glass panel having an upper surface with a plurality of edge portions. At least one of the edge portions is exposed.

20 Claims, 13 Drawing Sheets

(56) References Cited

U.S. PATENT DOCUMENTS

| | | | |
|---|---|---|---|
| 8,740,322 | B2 | 6/2014 | Moon et al. |
| 8,797,765 | B2 | 8/2014 | Lin et al. |
| 8,899,704 | B2 | 12/2014 | Bienick |
| 8,915,561 | B2 | 12/2014 | Eichman et al. |
| 9,134,063 | B2 | 9/2015 | Lim et al. |
| 9,345,326 | B2 | 5/2016 | Sankhgond et al. |
| 9,545,154 | B2 | 1/2017 | Duke |
| 9,562,714 | B2 | 2/2017 | Lim et al. |
| 2010/0253197 | A1 | 10/2010 | Jung |
| 2015/0292794 | A1 | 10/2015 | Bienick |

SHELF ASSEMBLY

CROSS-REFERENCE TO RELATED APPLICATIONS

This application is a continuation of U.S. application Ser. No. 15/852,139, filed on Dec. 22, 2017. This application is incorporated herein by reference.

FIELD OF THE INVENTION

This application relates generally to shelf assembly for a refrigeration appliance, and more particularly, to a shelf assembly having a rotatable shelf.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C., such as between 0.25° C. and 4.5° C. and the freezer compartments at temperatures below 0° C., such as between 0° C. and −20° C.

Each compartment of a refrigerator can include various storage structure for storing food items within the compartment such as, for example, one or more shelves or bins. In some examples, a rotatable shelf can be provided that can be rotated between a raised position and a lowered position to selectively provide a storage surface for items in the compartment. In the lowered position, the shelf can be substantially horizontal such that food items can rest on the shelf. In the raised position, the shelf can be flipped up against a wall of the compartment to provide extra room within the compartment for items on lower shelves.

In conventional designs, a rotatable shelf may inadvertently fall down from its flipped-up position due to gravity. Moreover, a rotatable shelf may be inadvertently bumped by a user when the shelf is in its lowered position, causing the shelf to rotate upward toward its raised position and disrupt items stored on the shelf. Still further, a rotatable shelf may have an unappealing aesthetic due to structure required (e.g., hinges, trims, etc.) for rotating coupling the shelf to the refrigerator cabinet.

BRIEF SUMMARY OF THE INVENTION

In accordance with a first aspect, there is provided a shelf assembly including a stationary hinge body, a rotating hinge body rotatably coupled to the stationary hinge body, and a shelf fixed to the rotating hinge body that is rotatable with the rotating hinge body relative to the stationary hinge body about a rotational axis. The shelf is rotatable between a first position and a second position. Moreover, the shelf assembly further includes a cam assembly configured to inhibit rotation of the shelf between its first position and second position. The cam assembly includes a cam that is fixed to one of the stationary hinge body and rotating hinge body, and a cam follower movably attached to the other of the stationary hinge body and rotating hinge body. The cam assembly further includes a biasing member that biases the cam follower into engagement with the cam. The rotatable shelf includes a glass panel having an upper surface and a lower surface, the upper surface having a plurality of edge portions. At least one of the plurality of edge portions of the upper surface is exposed.

In this manner, the shelf assembly according to the first aspect can inhibit accidental rotation of its rotating shelf between the first and second positions. Moreover, the exposed edge portion(s) of the assembly's glass panel can enable the shelf to have an improved appealing aesthetic, as described further below.

In some examples of the first aspect, the cam follower is slidingly coupled to the other of the stationary hinge body and rotating hinge body such that the cam follower is slidable along the rotational axis. Moreover, the biasing member can bias the cam follower along the rotational axis into engagement with the cam.

Further in some examples of the first aspect, the cam is fixed to the stationary hinge body and cam follower is slidingly coupled to the rotating hinge body such that the cam follower is slidable relative to the rotating hinge body along the rotational axis. Moreover, the cam follower can be configured to prohibit rotation of the cam follower relative to the rotating hinge body about the rotational axis.

Still further in some examples of the first aspect, the cam and cam follower each include a plurality of lobes that are symmetrically spaced about the rotational axis and project axially from a base body, and a plurality of recesses defined between the plurality of lobes that are symmetrically spaced about the rotational axis. Moreover, the cam assembly can be configured such that when the shelf is in the first position, the plurality of lobes of the cam follower will circumferentially align with the plurality of recesses of the cam about the rotational axis. Furthermore, the cam assembly can be configured such that when the shelf is in the second position, the plurality of lobes of the cam follower will circumferentially align with the plurality of recesses of the cam about the rotational axis.

Still yet further in some examples of the first aspect, the cam follower includes a shaft that is coaxial with the rotational axis, and the biasing member includes a coil spring that is provided around the shaft of the cam follower. Moreover, the coil spring can be compressed by a head of the cam follower and a wall member of the rotating hinge body such that the coil spring biases the cam follower along the rotational axis into engagement with the cam.

Further in some examples of the first aspect, the plurality of edge portions of the upper surface includes a front edge portion, a rear edge portion, a left edge portion, and a right edge portion. Moreover, the left edge portion and the right edge portion are exposed. Furthermore, the shelf can include a front trim member and a rear trim member attached to the glass panel, wherein the front trim member extends longitudinally along and a front side surface of the glass panel, and the rear trim member extends longitudinally along a rear side surface of the glass panel. Still further, the front trim member can extend longitudinally along the entire front side surface of the glass panel and the rear trim member can extend longitudinally along the entire rear side surface of the glass panel. Still yet further, the front trim member can cover the front edge portion of the glass panel and the rear trim member can cover the rear edge portion of the glass panel. Furthermore, the left edge portion of the glass panel can extend continuously along a major length of an associated left edge of the glass panel, and the right edge portion of the glass panel can extend continuously along a major length of an associated right edge of the glass panel. Still further, the right edge portion of the glass panel can extend continuously along the associated right edge of the glass panel from the front edge portion to the rear edge portion. Still yet further, the rotating hinge body can be fixed at one end to the first trim member and at another end to the second trim member. Furthermore, the upper surface of the glass panel can define an upper side of the glass panel and the lower surface of the glass panel can define a lower side of the glass panel, and the rotating hinge body can be disposed on the lower side of the glass panel.

In accordance with a second aspect, there is provided a shelf assembly including a stationary hinge body, a rotating hinge body rotatably coupled to the stationary hinge body, and a shelf fixed to the rotating hinge body that is rotatable with the rotating hinge body relative to the stationary hinge body about a rotational axis. The shelf is rotatable between a first position and a second position. Moreover, the shelf assembly further includes a cam assembly configured to inhibit rotation of the shelf between its first position and second position. The cam assembly includes a cam that is fixed to one of the stationary hinge body and rotating hinge body, and a cam follower slidingly coupled to the other of the stationary hinge body and rotating hinge body such that the cam follower is slidable along the rotational axis. The cam assembly further includes a biasing member that biases the cam follower into engagement with the cam.

In this manner, the shelf assembly according to the second aspect can inhibit accidental rotation of its rotating shelf between the first and second positions.

In accordance with a third aspect, there is provided a shelf assembly including a stationary hinge body, a rotating hinge body rotatably coupled to the stationary hinge body, and a shelf fixed to the rotating hinge body that is rotatable with the rotating hinge body relative to the stationary hinge body about a rotational axis. The shelf is rotatable between a first position and a second position. Moreover, the shelf includes a glass panel having an upper surface and a lower surface, the upper surface including a plurality of edge portions. At least one of the plurality of edge portions of the upper surface is exposed.

In this manner, the exposed edge portion(s) of the shelf assembly according to the third aspect can enable the assembly's shelf to have an improved appealing aesthetic, as described further below.

DESCRIPTION OF EXAMPLE EMBODIMENTS

Figure 1:
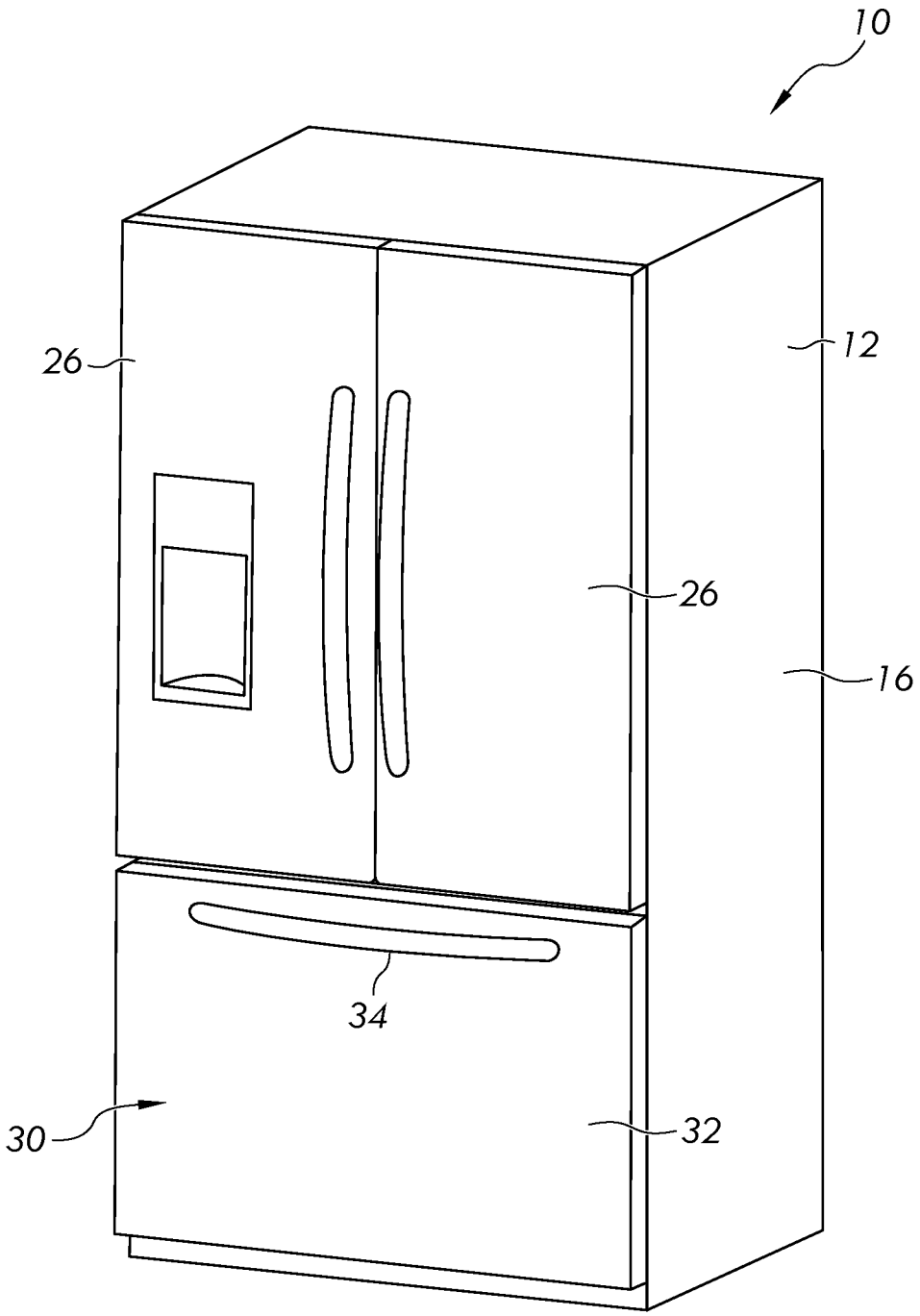
FIG. 1 is a front perspective view of an example refrigerator appliance, wherein doors and a drawer of the refrigerator are in a closed position.

Apparatus will now be described more fully hereinafter with reference to the accompanying drawings in which embodiments of the disclosure are shown. Whenever possible, the same reference numerals are used throughout the drawings to refer to the same or like parts. However, this disclosure may be embodied in many different forms and should not be construed as limited to the embodiments set forth herein.

Figure 2:
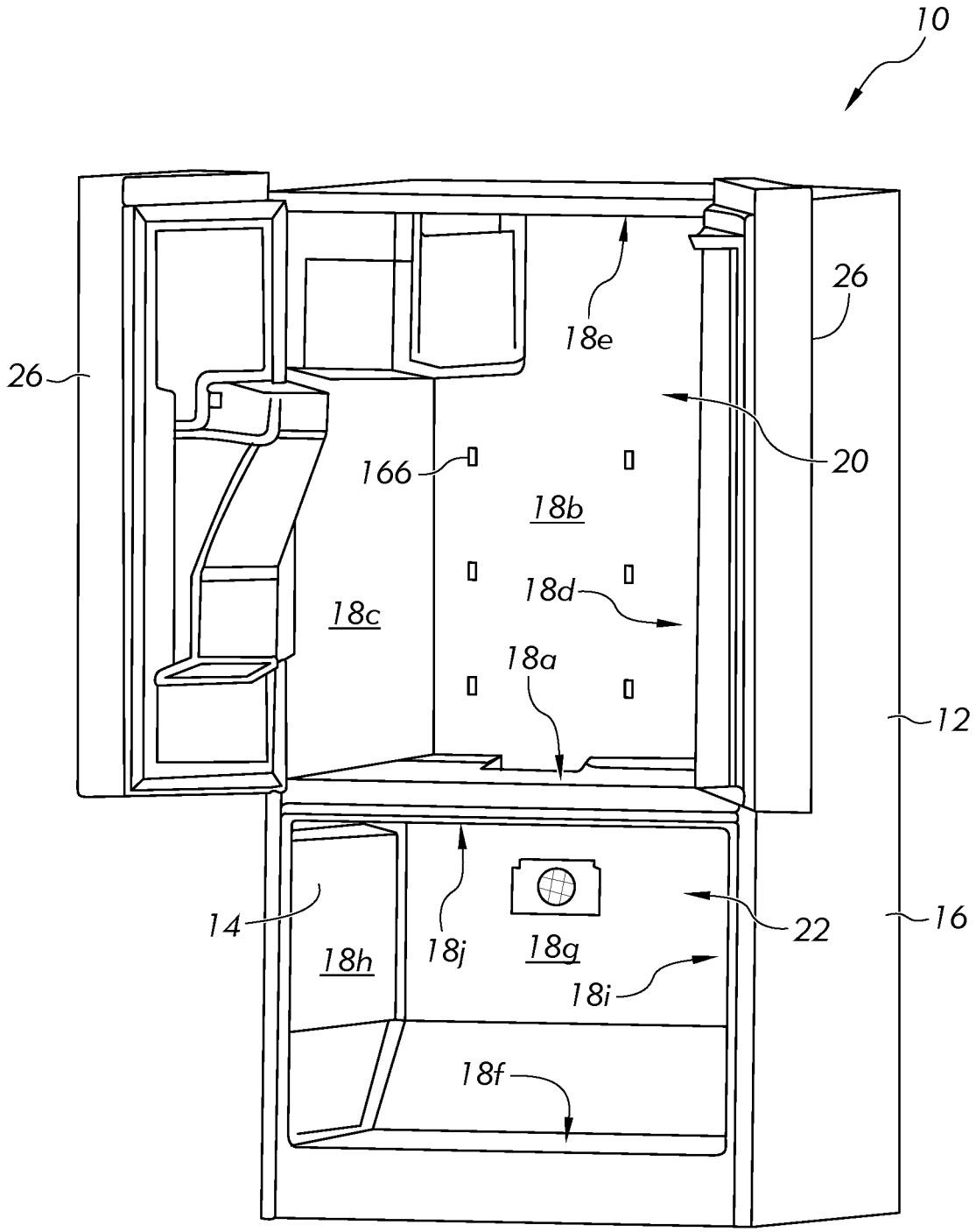
FIG. 2 is a front perspective view of the refrigerator of FIG. 1 showing the doors in an opened position and the drawer removed.

Referring now to the drawings, FIGS. 1 & 2 show an appliance, indicated generally at 10. Although the appliance 10 as illustrated and described below relates to a domestic refrigerator, the appliance 10 can be embodied by other domestic or commercial appliances.

The appliance 10 comprises a cabinet 12 that includes an inner liner 14 and an outer shell 16 surrounding the inner liner 14. The outer shell 16 can be attached to the inner liner 14 using one or more fastening elements (e.g., bolts, screws, nuts, brackets, etc.) Moreover, insulation material (e.g., polyurethane foam insulation) may be inserted into gaps between the outer shell 16 and inner liner 14 to provide thermal insulation for contents within the cabinet 12. The inner liner 14 can comprise a molded plastic sheet while the outer shell 16 comprises sheet metal. However, other materials may be used for the inner liner 14 and outer shell 16 in other embodiments.

The cabinet 12 can comprise one or more compartments that are defined by the inner liner 14 and can be used to, for example, store food items in a climate controlled environment. For example, the cabinet 12 can comprise a first compartment 20 defined by a first set of walls (i.e., bottom wall 18*a*, rear wall 18*b*, left wall 18*c*, right wall 18*d*, and top wall 18*e*) of the inner liner 14. Moreover, the cabinet 12 can comprise a second compartment 22 defined by a second set of walls (i.e., bottom wall 18*f*, rear wall 18*g*, left wall 18*h*, right wall 18*i*, and top wall 18*j*) of the inner liner 14. The first compartment 20 can be disposed vertically above the second compartment 22 or the first compartment 20 can be disposed vertically below the second compartment 22. In other examples, the first compartment 20 can be disposed laterally next to the second compartment 22.

The first compartment 20 can correspond to a fresh food compartment while the second compartment 22 corresponds to a freezer compartment, or vice versa. A configuration in which the freezer compartment is below the fresh food compartment can be referred to as a bottom mount configuration. However, the appliance 10 can have any desired configuration of one or more compartments, such as a top mount configuration (e.g., a freezer compartment disposed above a fresh food compartment), a side-by-side configuration (e.g., a fresh food compartment that is laterally next to a freezer compartment), or a standalone configuration (e.g., a standalone fresh food compartment or a standalone freezer compartment).

One or more doors can be pivotally coupled to the cabinet 12 to restrict and grant access to its compartment(s). For example, the appliance 10 can include a single door that spans the entire lateral distance across the entrance to the first compartment 20, or can include a pair of French-type doors 26 that collectively span the entire lateral distance of the entrance to the first compartment 20 to enclose the first compartment 20. One or more doors may be similarly provided to restrict and grant access to the second compartment 22.

In some examples, the appliance 10 can include a drawer assembly that can be withdrawn from a compartment to restrict and grant access to contents within the compartment. For example, the appliance 10 can include a drawer assembly 30 comprising a door 32 and one or more baskets (not shown) coupled to the door 32 that can be withdrawn (e.g., slid out) from the second compartment 22 to grant a user access to food items stored in the baskets or other areas in the second compartment 22. The door 32 can include a handle 34 that a user can grasp to pull the drawer assembly 30 open.

As discussed above, the first compartment 20 can correspond to a fresh food compartment while the second compartment 22 corresponds to a freezer compartment, or vice versa. The freezer compartment (e.g., second compartment 22) is used to freeze and/or maintain articles of food stored in the freezer compartment in a frozen condition. For this purpose, the freezer compartment is in thermal communication with a freezer evaporator (not shown) that removes thermal energy from the freezer compartment to maintain the temperature therein at a temperature of 0° C. or less during operation of the refrigerator 10, preferably between 0° C. and −50° C., more preferably between 0° C. and −30° C. and even more preferably between 0° C. and −20° C.

The fresh food compartment (e.g., first compartment 20) serves to minimize spoiling of articles of food stored therein. The fresh food compartment accomplishes this by maintaining the temperature in the fresh food compartment at a cool temperature that is typically above 0° C., so as not to freeze the articles of food in the fresh food compartment. It is contemplated that the cool temperature preferably is between 0° C. and 10° C., more preferably between 0° C. and 5° C. and even more preferably between 0.25° C. and 4.5° C. According to some embodiments, cool air from which thermal energy has been removed by the freezer evaporator can also be blown into the fresh food compartment to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator can optionally be dedicated to separately maintaining the temperature within the fresh food compartment independent of the freezer compartment. According to an embodiment, the temperature in the fresh food compartment can be maintained at a cool temperature within a close tolerance of a range between 0° C. and 4.5° C., including any subranges and any individual temperatures falling with that range. For example, other embodiments can optionally maintain the cool temperature within the fresh food compartment within a reasonably close tolerance of a temperature between 0.25° C. and 4° C.

Figure 3:
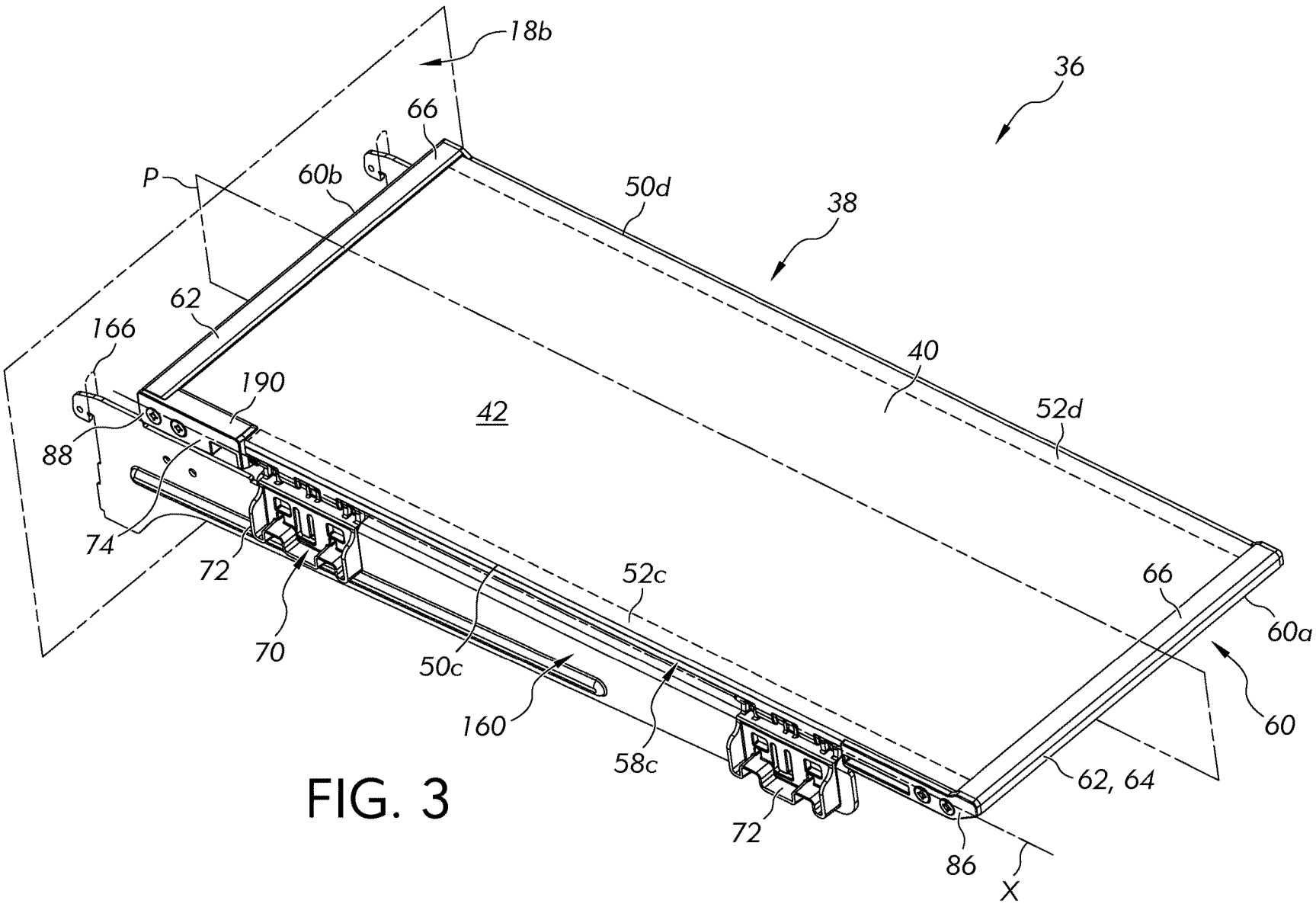
FIG. 3 is a front perspective view of an example shelf assembly for the refrigerator that includes a rotatable shelf, wherein the rotatable shelf is shown in a first position.
Figure 4:
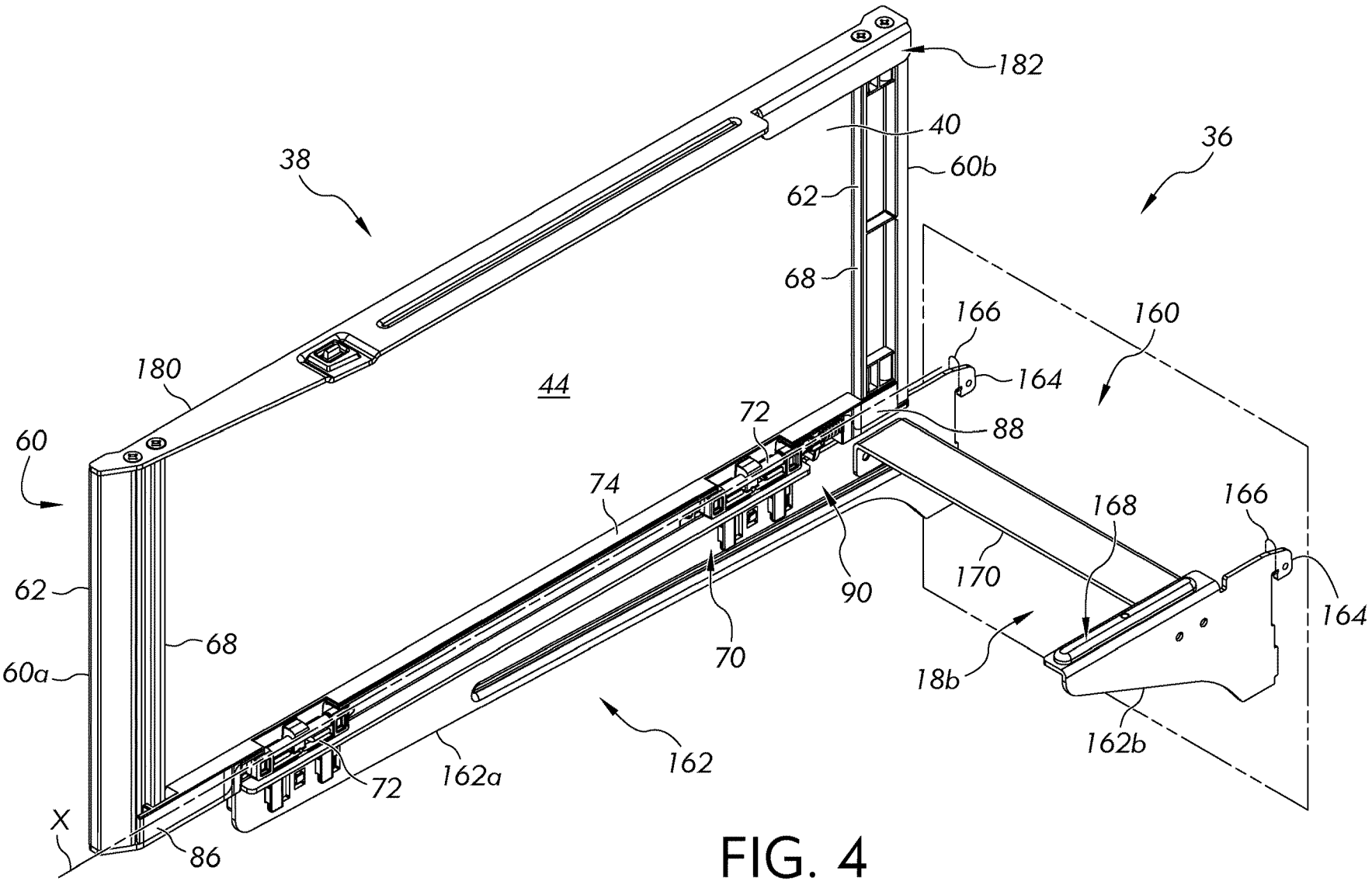
FIG. 4 is a front perspective view of the shelf assembly, wherein the rotatable shelf is in a second position.

Turning now to FIGS. 3-11, a shelf assembly 36 will now be described that includes a rotatable shelf 38 and can be provided within a compartment (e.g., first compartment 20 or second compartment 22) of the appliance 10. FIG. 3 illustrates the shelf assembly 36 with the shelf 38 rotated to a first position, while FIG. 4 illustrates the shelf assembly 36 with the shelf 38 rotated to a second position. FIGS. 5-11 illustrate various features of the shelf assembly 36 in close-up and/or in isolation.

In the first position, the shelf 38 can be horizontal to support food items thereon (see FIG. 3). Meanwhile, in the second position, the shelf 38 will be rotated from its first position (e.g., 90°) to provide space to store extra tall items on shelving below the rotatable shelf 38. Preferably, the shelf 38 will be vertical in its second position.

The rotatable shelf 38 includes a panel 40 for items to rest on. The panel 40 can be a glass panel, although other materials may be used for the panel 40 in other embodiments. For ease of illustration, the drawings show the panel 40 as an opaque structure. However, it is to be appreciated that the panel 40 may be transparent or translucent in some embodiments.

Figure 5:
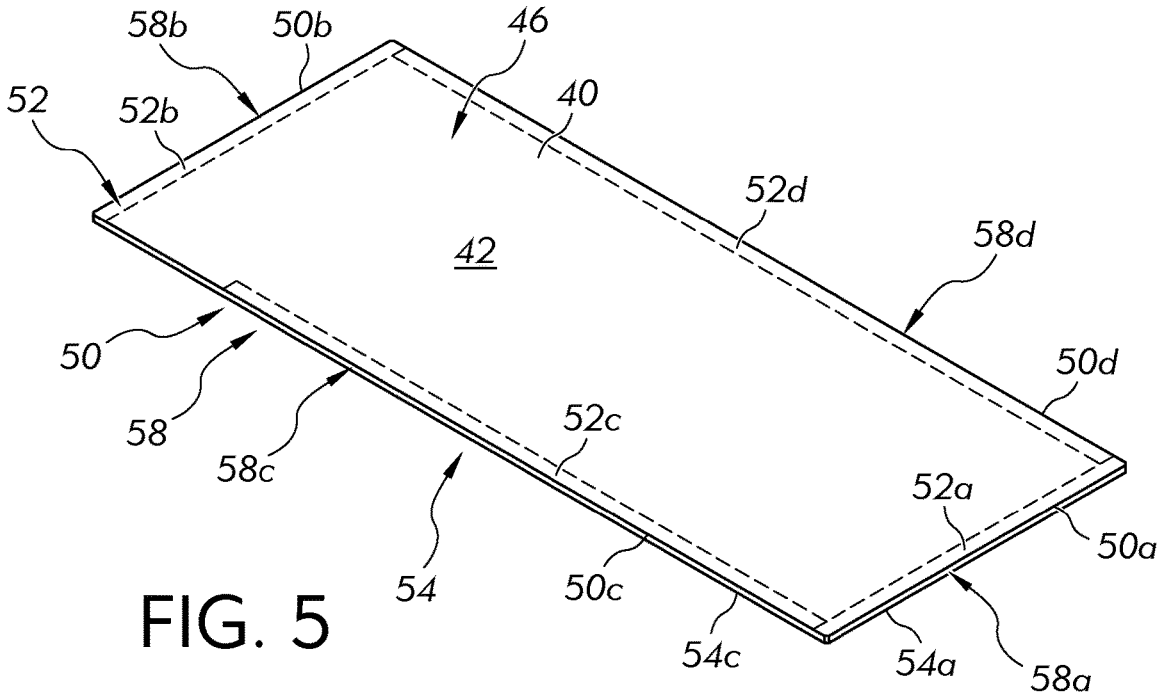
FIG. 5 is a top perspective view of a panel of the rotatable shelf.
Figure 6:
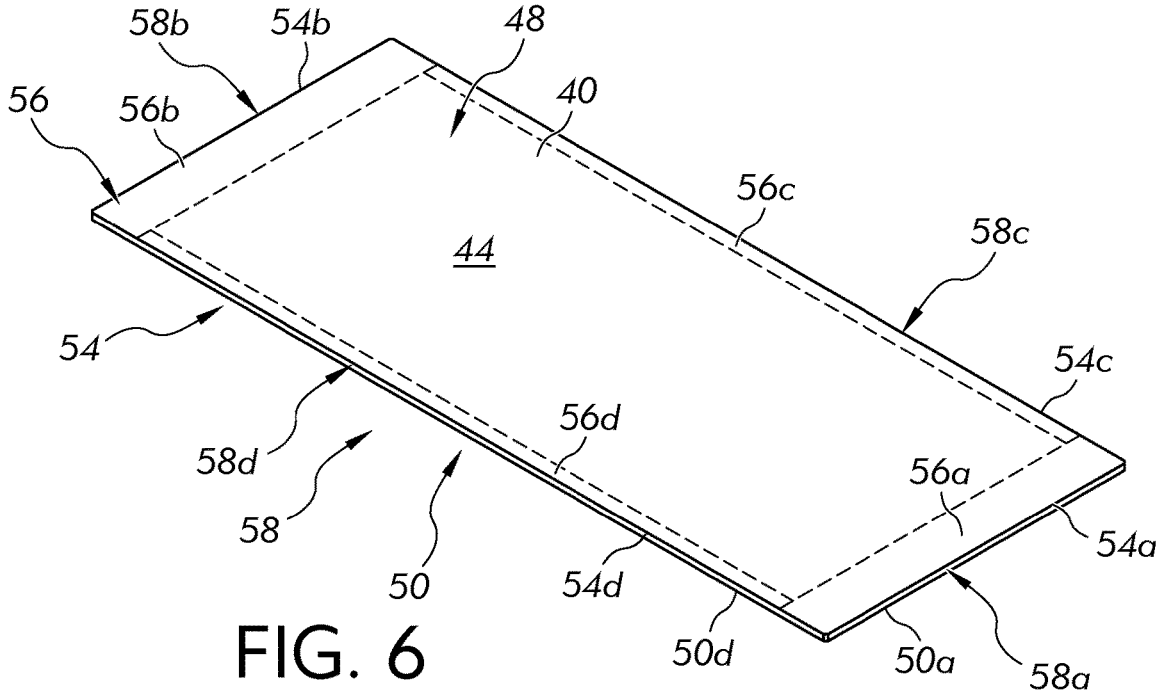
FIG. 6 is a bottom perspective view of the panel.

FIGS. 5 & 6 illustrate the glass panel 40 in isolation. In particular, FIG. 5 is a top perspective view of the glass panel 40, while FIG. 6 is a bottom perspective view of the glass panel 40. As can be seen in FIGS. 5 & 6, the glass panel 40 includes an upper surface 42 and a lower surface 44 spaced from the upper surface 42 that faces an opposite direction from the upper surface 42. The upper surface 42 defines an upper side 46 of the panel 40 and the lower surface 44 defines a lower side 48 of the panel 40.

The upper surface 42 of the glass panel 40 comprises a shape defined by a plurality of edges 50. For instance, as shown in FIG. 5, the upper surface 42 in the illustrated embodiment comprises a substantially rectangular shape defined by a front edge 50*a*, a rear edge 50*b*, a left edge 50*c*, and a right edge 50*d*. The front edge 50*a* and rear edge 50*b* are spaced from and extend substantially parallel to each other along a first direction. Meanwhile, the left edge 50*c* and the right edge 50*d* are spaced from and extend substantially parallel to each other along a second direction that is substantially perpendicular to the first direction. However, the upper surface 42 may comprise other shapes defined by edges of different configurations in other embodiments. Moreover, although the edges 50 in the present embodiment are all substantially straight, one or more of the edges 50 may be curved in other embodiments.

The upper surface 42 further includes a plurality of edge portions 52 that extend along its edges 50. For the purposes of this disclosure, reference to an "edge portion" of a surface means a portion of the surface that directly abuts an edge of the surface and extends along at least a portion of the edge. For example, as shown in FIG. 5, the upper surface 42 in the present embodiment includes a front edge portion 52*a* that extends along and abuts the front edge 50*a*, a rear edge portion 52*b* that extends along and abuts the rear edge 50*b*, a left edge portion 52*c* that extends along and abuts the left edge 50*c*, and a right edge portion 52*d* that extends along and abuts the right edge 50*d*.

Each edge portion 52 of the upper surface 42 can extend along and abut a portion of its associated edge 50 or an entirety of its associated edge 50. For example, the front edge portion 52*a* in the illustrated embodiment extends along and abuts the entire front edge 50*a* from the left edge 50*c* to the right edge 50*d*. Similarly, the rear edge portion 52*b* extends along and abuts the entire rear edge 50*b* from the left edge 50*c* to the right edge 50*d*. Meanwhile, the left and right edge portions 52*c*, 52*d* only extend partially along their respective edges 50*c*, 50*d*.

The lower surface 44 of the glass panel 40 has a substantially similar shape as the upper surface 42 and is similarly defined by a plurality of edges 54 (see FIG. 6). Each edge 54 of the lower surface 44 is spaced from and extends substantially parallel to a corresponding edge 50 of the upper surface 42. For example, the lower surface 44 in the present embodiment has a front edge 54*a* that is spaced from and extends substantially parallel to the front edge 50*a* of the upper surface 42, a rear edge 54*b* that is spaced from and extends substantially parallel to the rear edge 50*b* of the upper surface 42, a left edge 54*c* that is spaced from and extends substantially parallel to the left edge 50*c* of the upper surface 42, and a right edge 54*d* that is spaced from and extends substantially parallel to the right edge 50*d* of the upper surface 42.

The lower surface 44 also includes a plurality of edge portions 56 that extend along its edges 54. For example, the lower surface 44 in the present embodiment includes a front edge portion 56*a* that extends along and abuts the front edge 54*a*, a rear edge portion 56*b* that extends along and abuts the rear edge 54*b*, a left edge portion 56*c* that extends along and abuts the left edge 54*c*, and a right edge portion 56*d* that extends along and abuts the right edge 54*d*. Each edge portion 56 can extend along and abut a portion of its associated edge 54 or an entirety of its associated edge 54. For example, the front edge portion 56*a* in the illustrated embodiment extends along and abuts the entire front edge 54*a* from the left edge 54*c* to the right edge 54*d*. Similarly, the rear edge portion 56*b* extends along and abuts the entire rear edge 54*b* from the left edge 54*c* to the right edge 54*d*. Meanwhile, the left and right edge portions 56*c*, 56*d* only extend partially along their respective edges 54*c*, 54*d*.

The glass panel 40 further includes a plurality of side surfaces 58 that extend between and abut corresponding edges 50, 54 of the upper surface 42 and lower surface 44. For example, the glass panel 40 in the present embodiment includes a front side surface 58*a* that extends between and abuts the front edge 50*a* of the upper surface 42 and the front edge 54*a* of the lower surface 44, a rear side surface 58*b* that extends between and abuts the rear edge 50*b* of the upper surface 42 and the rear edge 54*b* of the lower surface 44, a left side surface 58*c* that extends between and abuts the left edge 50*c* of the upper surface 42 and the left edge 54*c* of the lower surface 44, and a right side surface 58*d* that extends between and abuts the right edge 50*d* of the upper surface 42 and the right edge 54*d* of the lower surface 44.

Figure 7:
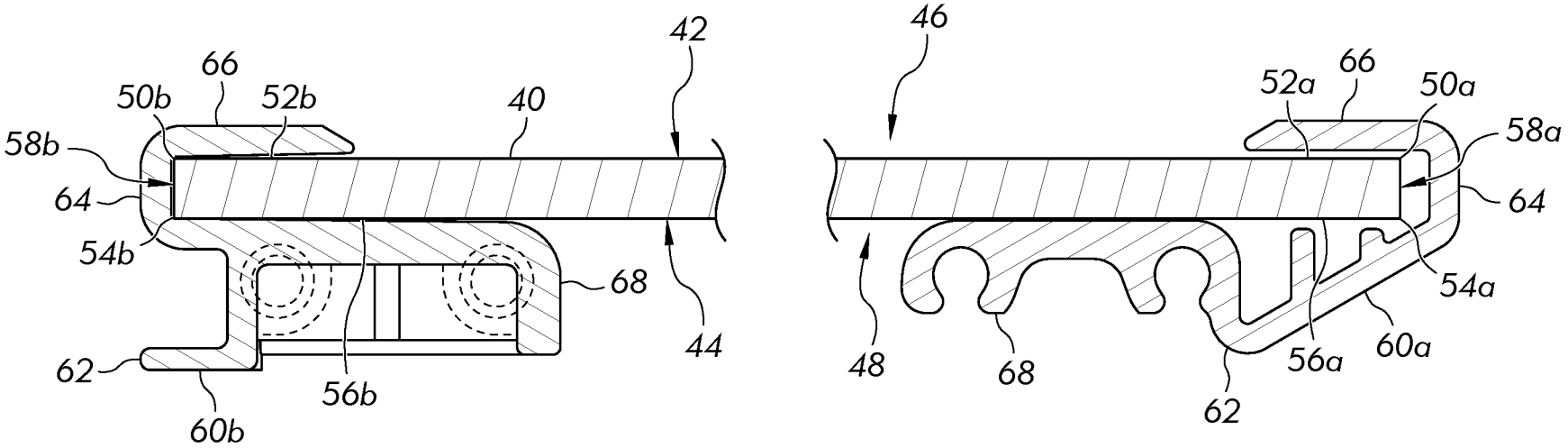
FIG. 7 is a cross-section view of the rotatable shelf, taken along plane P in FIG. 3.

The rotatable shelf 38 can further include one or more trim members 60 attached to the glass panel 40 that extend along one or more of its side surfaces 58 (as shown in FIGS. 3, 4 and 7). Each trim member 60 can comprise an elongated body 62 having an outer portion 64 that faces its associated side surface 58, an upper portion 66 that extends inward (i.e., toward a center of the glass panel 40) from the outer portion 64 on the upper side 46 of the glass panel 40, and a lower portion 68 that extends inward (i.e., toward a center of the glass panel 40) from the outer portion 64 on the lower side 48 of the glass panel 40. The outer portion 64, upper portion 66, and lower portion 68 of the elongated body 62 collectively have a cross-section (taken perpendicular to a longitudinal axis of the elongated body 62) that is substantially C-shaped such that the elongated body 62 can wrap around associated edges of the glass panel 40.

For example, as shown in FIG. 7, the rotatable shelf 38 can comprise a front trim member 60*a* having an elongated body 62 that extends longitudinally along the front side surface 58*a* of the glass panel 40 and wraps around the front edge 50*a* of the upper surface 42 and the front edge 54*a* of the lower surface 44. In particular, the elongated body 62 of the front trim member 60*a* includes an outer portion 64 that faces the front side surface 58*a*, an upper portion 66 that extends inward from the outer portion 64*a* on the upper side 46 of the glass panel 40, and a lower portion 68 that extends inward from the outer portion 64*a* on the lower side 48 of the glass panel 40.

The front trim member 60*a* can extend longitudinally along the entire front side surface 58*a* of the glass panel 40 such that the upper portion 66 of the front trim member 60*a* covers the entire front edge portion 52*a* of the upper surface 42 (for the purposes of this disclosure, description of a trim portion that "covers" a surface portion means that the trim portion is disposed such that an imaginary vector normal to the surface portion passes through the trim portion). However, in some examples, the front trim member 60*a* may extend along only a portion of the front side surface 58*a* and may only partially cover the front edge portion 52*a*.

As another example, the rotatable shelf 38 can comprise a rear trim member 60*b* (also shown in FIG. 7) having an elongated body 62 that extends longitudinally along the rear side surface 58*b* of the glass panel 40 and wraps around the rear edge 50*b* of the upper surface 42 and the rear edge 54*b* of the lower surface 44. In particular, the elongated body 62 of the rear trim member 60*b* includes an outer portion 64 that faces the rear side surface 58*b*, an upper portion 66 that extends inward from the outer portion 64*b* on the upper side 46 of the glass panel 40, and a lower portion 68 that extends inward from the outer portion 64*b* on the lower side 48 of the glass panel 40. The rear trim member 60*b* can extend longitudinally along the entire rear side surface 58*b* of the glass panel 40 such that the upper portion 66 of the rear trim member 60*b* covers the entire rear edge portion 52*b* of the upper surface 42. However, in some examples, the rear trim member 60*b* may extend along only a portion of the rear side surface 58*b* and may only partially cover the rear edge portion 52*b*.

The rotatable shelf 38 can include either or both of the front and rear trim members 60*a*, 60*b* described above. In addition or alternatively, the rotatable shelf 38 can include a trim member 60 associated with its left side surface 58*c* and/or a trim member 60 associated with its right side surface 58*d*.

In some examples, one or more side surfaces 58 of the glass panel 40 can be trimless such that one or more edge portions 52 of the upper surface 42 are exposed. For instance, in the illustrated embodiment, no trim members are associated with the left side surface 58*c* and right side surface 58*d* of the glass panel 40 (see FIG. 3). Accordingly, the entire left edge portion 52*c* of the upper surface 42 is exposed. Likewise, the entire right edge portion 52*d* of the upper surface 42 is exposed. For the purposes of this disclosure, reference to an edge portion of a surface as "exposed" means that the edge portion is not covered by a trim or other structure of the rotatable shelf. More specifically, an imaginary vector normal to the edge portion does not pass through any trim or other structure of the rotatable shelf.

Providing the glass panel 40 with one or more exposed edge portions 52 can create an improved appealing aesthetic for the rotatable shelf 38. Furthermore, providing one or more exposed edge portions 52 can increase an amount of storage area on the upper surface 42 of the glass panel 40. Preferably, the glass panel 40 will have multiple exposed edge portions 52, each edge portion 52 extending continuously along a major length of its associated edge 50. For the purposes of this disclosure, reference to a "major length" of an edge means 51% or more of the edge's length, preferably, 75% or more of the edge's length, and more preferably, 85% or more of the edge's length.

For instance, in the illustrated embodiment, the exposed right edge portion 52*d* extends continuously along a major length of its associated right edge 50*d*, from the front edge portion 52*a* to the rear edge portion 52*b* (as shown in FIG. 5). Moreover, the exposed left edge portion 52*c* also extends continuously along a major length of its associated left edge 50*c*, although not completely from the front edge portion 52*a* to the rear edge portion 52*b*. As will be discussed further below, the exposed left edge portion 52*c* is slightly spaced from the rear edge portion 52*b* to provide an area for a stability bracket 190 to extend over the upper side 46 of the glass panel 40. However, it is to be appreciated that the exposed left edge portion 52*c* could extend completely from the front edge portion 52*a* to the rear edge portion 52*b* in some embodiments.

The front and rear edge portions 52*a*, 52*b* of the upper surface 42 in the illustrated embodiment are both covered by associated trim members 60*a*, 60*b*, while the left and right edge portions 52*c*, 52*d* are exposed. However, it is to be appreciated that in alternative embodiments, any number of the edge portions 52 can be exposed or covered by an associated trim member 60. Indeed, in some examples, all edge portions 52 of the upper surface 42 can be exposed or all edge portions 52 of the upper surface 42 can be covered by an associated trim member 60. In other examples, one or more edge portions 52 of the upper surface 42 can be exposed while one or more other edge portions 52 of the upper surface 42 are covered by an associated trim member 60.

The shelf assembly 36 further includes a hinge assembly 70 (as shown in FIGS. 3 & 4 and more closely in FIGS. 8-11) for rotatably mounting the shelf 38 within a compartment of the cabinet 12. The hinge assembly 70 can include at least one stationary hinge body 72 and at least one rotating hinge body 74 that is/are rotatably coupled to the at least one stationary hinge body 72. For example, in the illustrated embodiment, the hinge assembly 70 includes a single rotating hinge body 74 that is rotatably coupled to two stationary hinge bodies 72. However, in other examples, the hinge assembly 70 can include two rotating hinge bodies 74 that are both rotatably coupled to a single stationary hinge body 72. Still in other examples, the hinge assembly 70 can comprise a first rotating hinge body 74 that is rotatably coupled to a first stationary hinge body 72, and second rotating hinge body 74 that is rotatably coupled to a second stationary hinge body 72. The hinge assembly 70 can comprise a variety of different configurations having at least one stationary hinge body 72 and at least one rotating hinge body 74 that is rotatably coupled to the at least one stationary hinge body 72.

To rotatably couple a rotating hinge body 74 to a stationary hinge body 72, the hinge assembly 70 can comprise a first attachment structure 76 that is fixed to (e.g., integral with or separately attached to) the stationary hinge body 72 and a second attachment structure 78 that is fixed to (e.g., integral with or separately attached to) the rotating hinge body 74. In the illustrated embodiment, the first attachment structure 76 comprises a cylindrical shaft 82 while the second attachment structure 78 comprises one or more arms 84 that receive the shaft 82 and extend partially about a circumference of the shaft 82 to rotatably engage the shaft 82. In particular, the arms 84 have a resilient snap fit onto the shaft 82. However, in other examples, the first attachment structure 76 can comprise the one or more arms 84 while the second attachment structure 78 comprises the shaft 82. Moreover, in some examples, the one or more arms 84 can extend around an entire circumference of the shaft 82.

Each rotating hinge body 74 of the hinge assembly 70 is configured to rotate (relative to the one or more stationary hinge bodies 72) about an axis X. In the present example, the axis X corresponds to an axis of the shaft 82. Moreover, each rotating hinge body 74 can be fixed to the shelf 38 such that the shelf 38 will rotate with the rotating hinge body 74 (and relative to the one or more stationary hinge bodies 72) about the axis X. Each rotating hinge body 74 can be fixed to the shelf 38 by fixing the rotating hinge body 74 to one or more of the trim members 60 described above. For example, in the illustrated embodiment of FIG. 3, one end 86 of the rotating hinge body 74 is fixed to the front trim member 60*a*, while another end 88 of the rotating hinge body 74 is fixed to the rear trim member 60*b*. In particular, the rotating hinge body 74 is fixed to the front and rear trim members 60*a*, 60*b* such that the rotating hinge body 74 is disposed on the lower side 48 of the glass panel 40 and extends along the left edge portion 56*c* of the lower surface 44. The rotating hinge body 74 can be fixed to the front and rear trim members 60*a*, 60*b* using one or more fastening elements (e.g., screws, clips, adhesive, etc.) or by forming the rotating hinge body 74 integrally with the front and rear trim members 60*a*, 60*b*.

In the illustrated embodiment, the rotating hinge body 74 is fixed to the shelf 38 such that the rotational axis X is adjacent and extends parallel to the left side surface 58*c* of the glass panel 40. However, in other embodiments, the rotating hinge body 74 can be fixed to the shelf 38 such that its rotational axis X is adjacent and extends parallel to other side surfaces 58 of the glass panel 40. For example, in some embodiments, the rotating hinge body 74 can be fixed to the front and rear trim members 60*a*, 60*b* such that its rotational axis X is adjacent and extends parallel to the right side surface 58*d* of the glass panel 40. Still in other examples, the rotating hinge body 74 can be fixed to the rear trim member 60*b* such that its rotational axis X is adjacent and extends parallel to the rear side surface 58*b* of the glass panel 40.

However the rotating hinge body 74 is fixed to the shelf 38, the rotating hinge body 74 is preferably fixed in a manner such that the rotating hinge body 74 is disposed on the lower side 48 of the glass panel 40. In particular, the rotating hinge body 74 is preferably fixed in a manner such that no portion (or a minimal portion) of the rotating hinge body 74 is disposed on the upper side 46 of the glass panel 40.

Each stationary hinge body 72 of the hinge assembly 70 can be fixed to the cabinet 12 of the appliance 10 in a variety of different ways. For example, a stationary hinge body 72 can be formed integrally with a wall (e.g., the rear wall 18*b*, the left wall 18*c*, the right wall 18*d*, etc.) of the inner liner 14 or can be directly attached to the wall via one or more fastening elements (e.g., screws, clips, adhesive, etc.) such that the rotational axis X of the hinge assembly 70 is adjacent to and extends substantially parallel with the wall. In other examples, a stationary hinge body 72 can be indirectly attached to a wall of the inner liner 14 via other support structure. For instance, each stationary hinge body 72 in the illustrated embodiment is fixed to a support unit 160 (which will be described further below) that indirectly fixes the stationary hinge bodies 72 to the rear wall 18*b* of the cabinet.

As described above, the at least one stationary hinge body 72 of the hinge assembly 70 can be fixed to the cabinet 12, while the at least one rotating hinge body 74 of the hinge assembly 70 can be fixed to the shelf 38. In this manner, the hinge assembly 70 can permit the shelf 38 to rotate (relative to the at least one stationary hinge body 72 and the cabinet 12 fixed thereto) about the rotational axis X of the hinge assembly 70 between a first position and a second position.

In the first position, the upper and lower surfaces 42, 44 of the shelf's panel 40 will be substantially horizontal such that the upper surface 42 faces upward and the lower surface 44 faces downward (see FIG. 3). Moreover, the rear side surface 58*b* will face and be preferably substantially parallel to the rear wall 18*b* of the inner liner 14, the left side surface 58*c* will face and be preferably substantially parallel to the left wall 18*c* of the inner liner 14, and the right side surface 58*d* will face and be preferably substantially parallel to a right wall 18*d* of the inner liner 14. In some embodiments, the glass panel 40 will span substantially an entire distance between the left wall 18*c* and the right wall 18*d*. In other embodiments, the glass panel 40 may be substantially spaced from the left wall 18*c* and/or the right wall 18*d*. In the illustrated embodiment, the glass panel 40 is sized such that the glass panel 40 spans only a partial distance between the left wall 18*c* and the right wall 18*d*.

In the second position, the upper and lower surfaces 42, 44 of the glass panel 40 will be sloped (see FIG. 4). For instance, in the illustrated embodiment, when the shelf 38 is in the second position, the upper and lower surfaces 42, 44 are substantially vertical (e.g., 90° perpendicular to horizontal). In particular, the upper surface 42 will face and be preferably substantially parallel with the left wall 18*c* of the inner liner 14, while the lower surface 44 will face and be preferably substantially parallel with the right wall 18*d* of the inner liner 14. Moreover, the upper surface 42 will be adjacent and relatively close to the left wall 18*c*, while the lower surface 44 will be spaced relatively far away from the right wall 18*d*. However, in other embodiments, the upper and lower surfaces 42, 44 may be angled in the second position such that the upper and lower surfaces 42, 44 are not vertically aligned.

The arrangement of the glass panel 40 when the shelf 38 is in the second position can vary between embodiments depending on how the hinge assembly 70 rotatably attaches the shelf 38 to the cabinet 12. The illustrated embodiment is only one example. For instance, in other examples, the hinge assembly 70 may be coupled to the cabinet 12 and shelf 38 such that the rotational axis X is adjacent and extends parallel to the rear wall 18*b* of the inner liner 14 and the rear side surface 58*b* of the glass panel 40. In such examples, the upper surface 42 of the glass panel 40 in the second position can be adjacent to and parallel with the rear wall 18*b*. In other examples, the hinge assembly 70 may be coupled to the cabinet 12 and shelf 38 such that the rotational axis X is adjacent and extends parallel to the right wall 18*d* of the inner liner 14 and the right side surface 58*d* of the glass panel 40. In such examples, the upper surface 42 of the glass panel 40 in the second position can be adjacent to and parallel with the right wall 18*d*.

In some examples, the hinge assembly 70 can include a cam assembly 90 (see FIGS. 8-11) that is configured to inhibit rotation of the shelf 38 between its first position and second position (e.g., from its first position toward its second position, from its second position toward its first position, or both directions). The cam assembly 90 includes a cam 92, a cam follower 94, and a biasing member 96 that biases the cam follower 94 into engagement with the cam 92. The cam 92 can be fixed to (e.g., formed integrally with or separately attached to) one of the stationary hinge body 72 and rotating hinge body 74 described above. Meanwhile, the cam follower 94 can be movably coupled to the other of the stationary hinge body 72 and rotating hinge body 74. In the illustrated embodiment, the cam 92 is formed integrally with the stationary hinge body 72. Meanwhile, the cam follower 94 is movably coupled to the rotating hinge body 74. However, in other examples, the cam 92 can be formed integrally with the rotating hinge body 74 while the cam follower 94 is movably coupled to the stationary hinge body 72.

Figure 10:
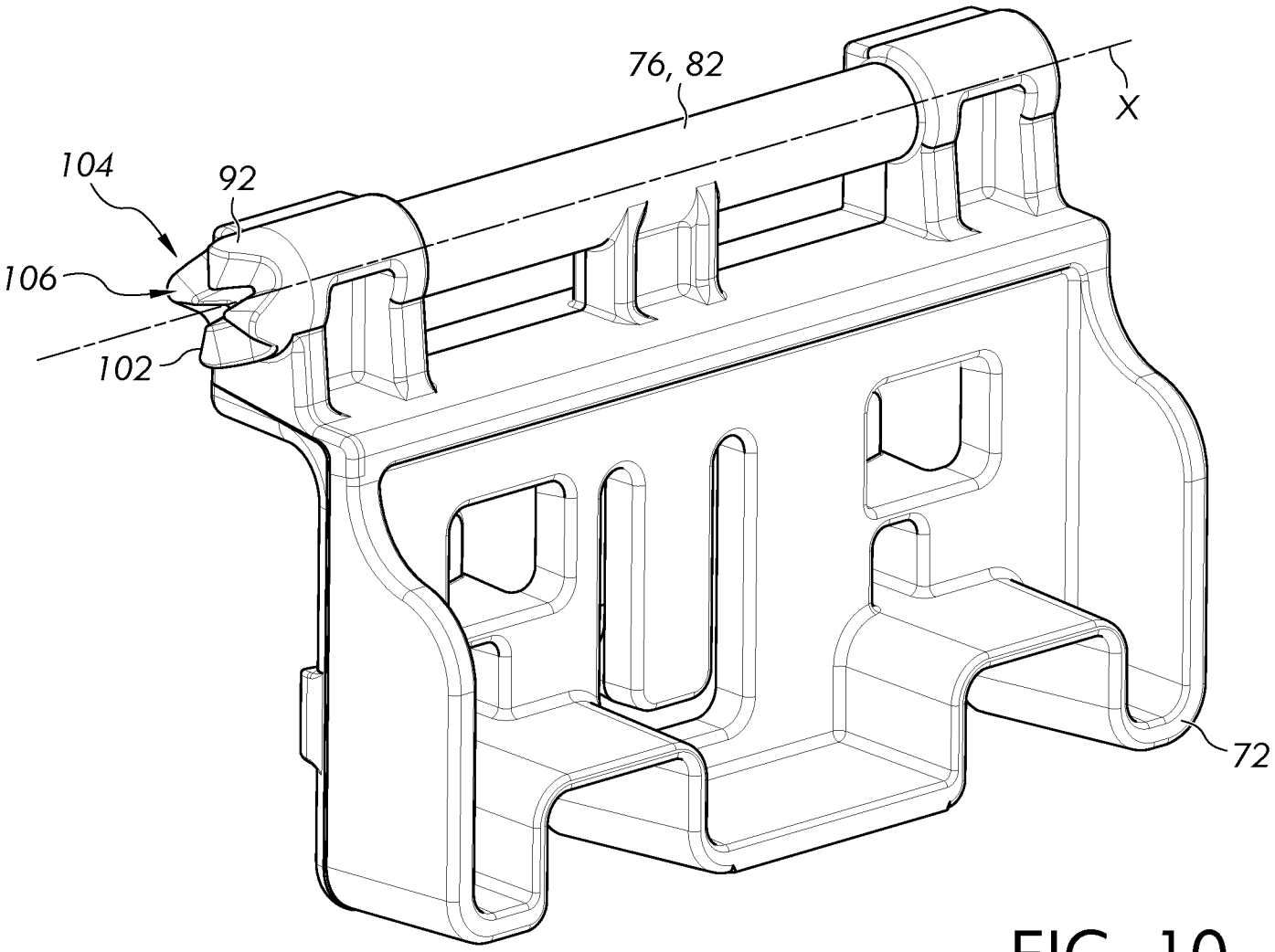
FIG. 10 is a perspective view of a stationary hinge body and a cam of the shelf assembly.
Figure 11:
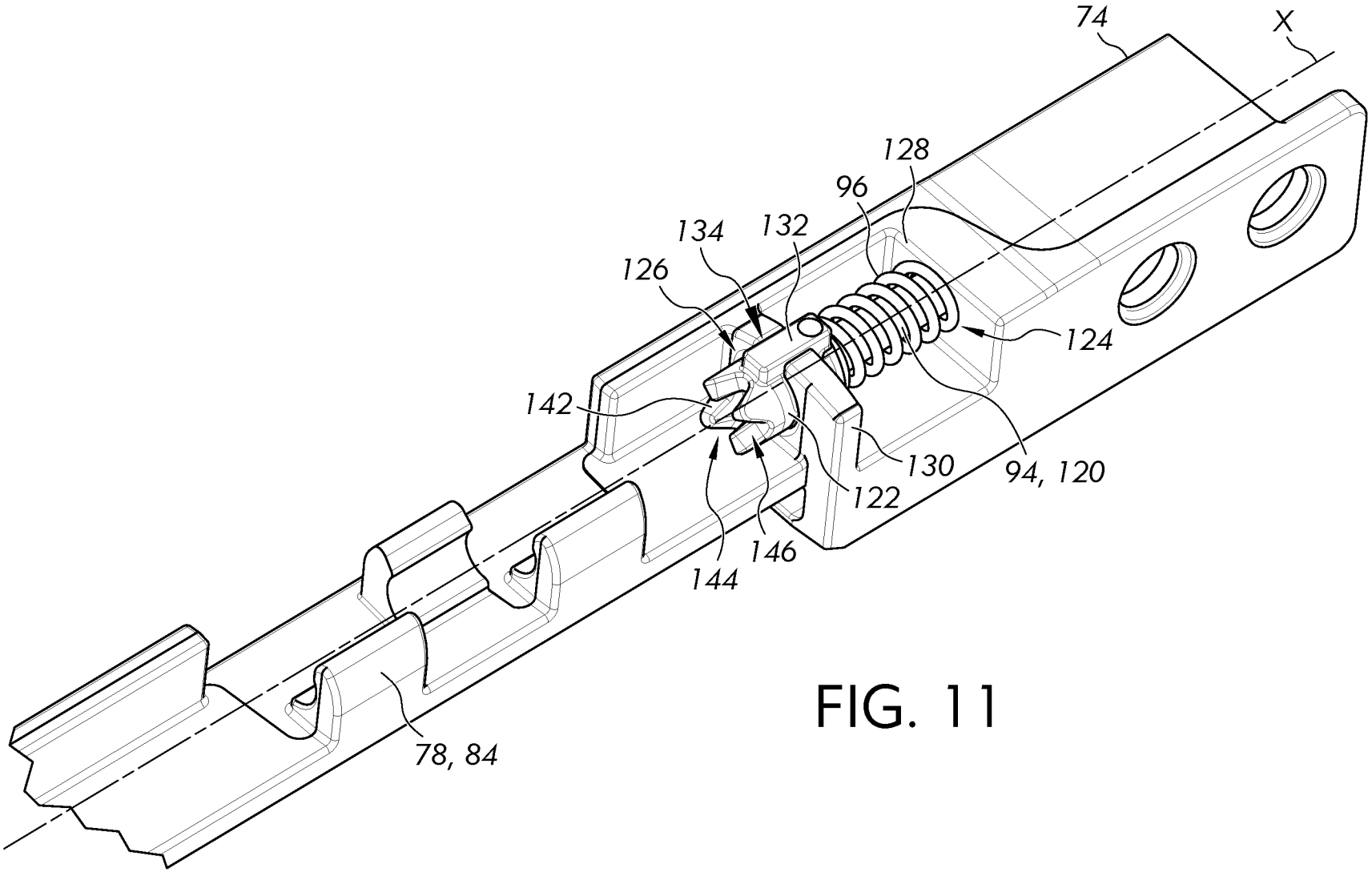
FIG. 11 is an enlarged perspective view of a rotating hinge body, a cam follower, and a biasing member of the shelf assembly.

As shown in FIG. 10, the cam 92 can include a plurality of lobes 102 that are symmetrically spaced about an axis (e.g., rotational axis X) and project axially (i.e., along the rotational axis X) from a base body (e.g., stationary hinge body 72). Between the lobes 102 are defined a plurality of recesses 104 which are also symmetrically spaced about the rotational axis X. The spacing of the lobes 102 about the axis X can correspond to an angle of rotation for the shelf 38 between its first and second positions. For instance, in the illustrated embodiment, the shelf 38 is configured to rotate 90° between its first and second positions. Accordingly, the cam 92 can include four lobes 102 that are symmetrically spaced 90° apart from each other (e.g., when measured peak-to-peak) about the axis X. However, the spacing of the lobes 102 need not correspond exactly to an angle of rotation for the shelf 38 in other embodiments. For instance, in examples wherein the shelf 38 is configured to rotate 90° between its first and second positions, the cam 92 may have three lobes 102 that are symmetrically spaced 120° apart from each other about the axis X.

Figure 12:
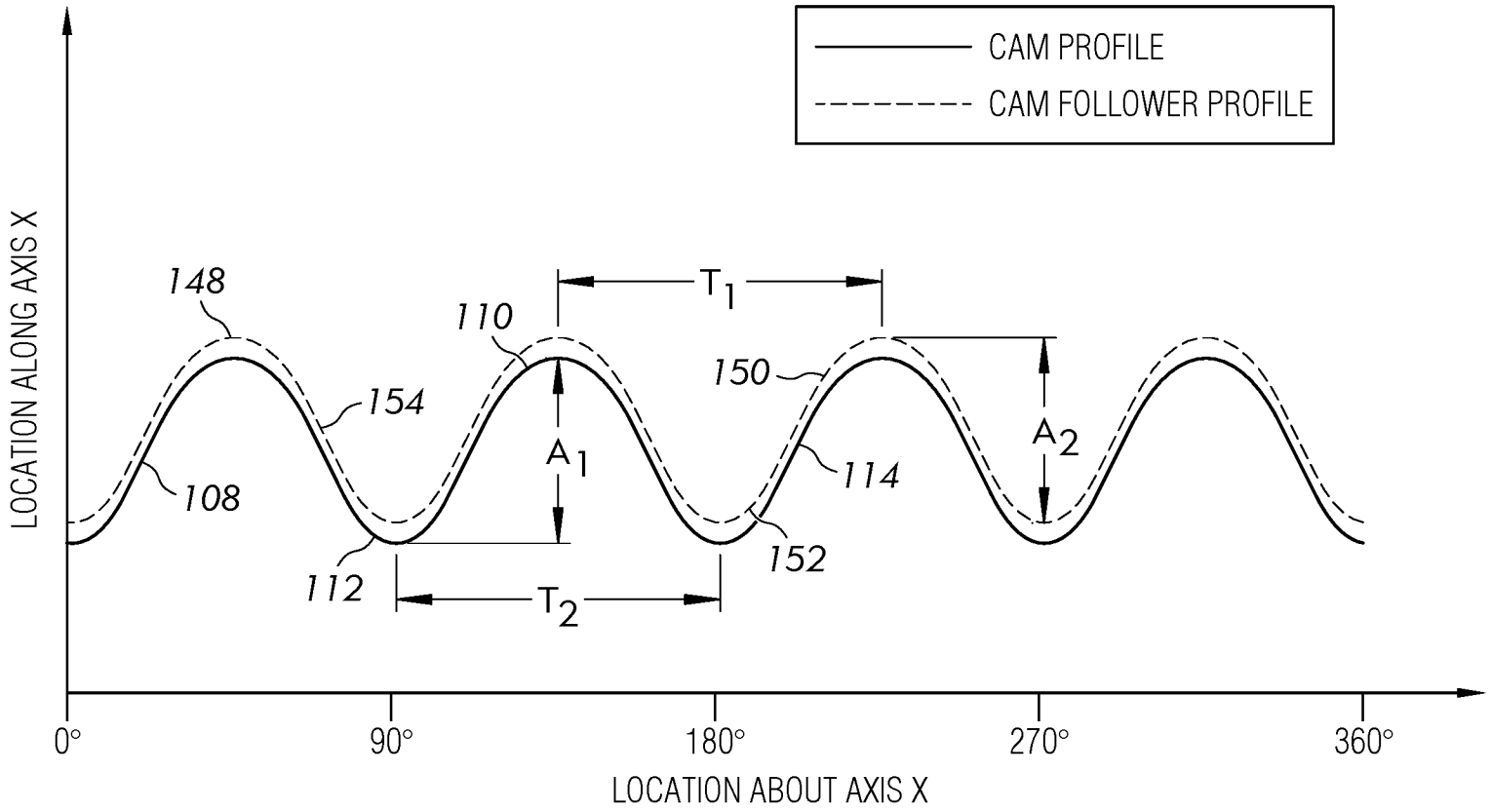
FIG. 12 is a graph illustrating a profile of the cam and a profile of the cam follower.

The plurality of lobes 102 collectively define a cam surface 106 that extends circumferentially about the axis X. FIG. 12 is a graph that illustrates a profile 108 of the cam surface 106 about the axis X. The horizontal axis in FIG. 12 corresponds to an angular location about the axis X, while the vertical axis corresponds to an axial location along the axis X.

As can be seen in FIG. 12, the cam surface 106 can have a profile 108 that is substantially sinusoidal such that the cam surface 106 gradually rises and falls about the axis X. In particular, the profile 108 can comprise rounded peaks 110 and rounded valleys 112 that are connected via moderately-sloped ramped portions 114. An amplitude $A_1$ of the profile 108 is defined as the axial distance between its peaks 110 and valleys 112, while a period $T_1$ of the profile 108 is defined the angular distance between adjacent peaks 110. However, the profile 108 may comprise other configurations in other embodiments. For instance, in some examples, the peaks 110 and/or valleys 112 of the profile 108 may be plateaued or may comprise a sharp (i.e., non-rounded) corner. Moreover, in some examples, the ramped portions 114 may have a greater or smaller slope. Furthermore, in some examples, the profile 108 may have a different amplitude A and/or period T.

As noted above, the cam follower 94 can be movably coupled to one of the stationary hinge body 72 and rotating hinge body 74. For example, in the illustrated embodiment, the cam follower 94 is slidingly coupled to the rotating hinge body 74 (see FIG. 11). In particular, the cam follower 94 comprises a shaft 120 and a head 122 that is fixed to an end of the shaft 120. Meanwhile, the rotating hinge body 74 defines a first channel 124 that is configured to slidingly receive the shaft 120 of the cam follower 94, and a second channel 126 that is configured to slidingly receive the head 122 of the cam follower 94. The first channel 124 is defined by a first wall member 128 of the rotating hinge body 74, while the second channel 126 is defined by a second wall member 130 of the rotating hinge body 74 that is spaced axially (i.e., relative to the rotational axis X) from the first wall member 128.

The cam follower 94 can be slidingly received within the first and second channels 124, 126 such that its shaft 120 and head 122 are coaxial with the rotational axis X and the cam follower 94 can slide relative to the rotating hinge body 74 along the axis X. Moreover, the cam follower 94 can be configured to prohibit rotation of the cam follower 94 relative to the rotating hinge body 74 about the axis X. For instance, in the illustrated embodiment, the cam follower 94 includes a key 132 that protrudes radially from the head 122 of the cam follower 94 and extends longitudinally in the axial direction. The key 132 will be received within a portion 134 of the second channel 126 that is limited in the circumferential direction (i.e., a direction about rotational axis X) such that the cam follower 94 cannot rotate within the second channel 126 relative to the rotating hinge body 74.

The cam follower 94 may comprise additional or alternative structure in other embodiments that prohibits rotation of the cam follower 94 relative to the rotating hinge body 74. For instance, in some examples, the shaft 120 of the cam follower 94 can comprise a cross-section (e.g., taken perpendicular to the axis X) that has a polygonal shape (e.g., square, hexagon, octagon, etc.) and the first channel 124 of rotating hinge body 74 can comprise a similar cross-section shape. In addition or alternatively, the head 122 of the cam follower 94 can comprise a cross-section (e.g., taken perpendicular to the axis X) that has a polygonal shape (e.g., square, hexagon, octagon, etc.) and the second channel 126 of rotating hinge body 74 can comprise a similar cross-section shape.

The cam follower 94 can also include a plurality of lobes 142 that are symmetrically spaced about an axis (e.g., rotational axis X) and project axially (i.e., along rotational axis X) from a base body (e.g., the head 122 of the cam follower 94). Between the lobes 142 are defined a plurality of recesses 144 that are also symmetrically spaced about the rotational axis X. The lobes 142 of the cam follower 94 can define a cam surface 146 that extends circumferentially about the axis X and is complimentary to the cam surface 106 of the cam 92. Thus, the cam 92 and the cam follower 94 can be axially aligned and pressed together axially such that the lobes 142 of the cam follower 94 are received by and mate with the recesses 104 of the cam 92, while the lobes 102 of the cam 92 are received by and mate with the recesses 144 of the cam follower 94.

FIG. 12 illustrates a profile 148 of the cam follower's cam surface 146 about the axis X. As can be seen in FIG. 12, the profile 148 of the cam follower 94 is complementary to the profile 108 of the cam 92. In particular, the profile 148 of the cam follower 94 includes rounded peaks 150 and rounded valleys 152 that are connected via moderately-sloped ramped portions 154. An amplitude $A_2$ of the profile 148 is defined as the axial distance between its peaks 150 and valleys 152, while a period $T_2$ of the profile 148 is defined as the angular distance between adjacent valleys 152. The peaks 150 of the cam follower's profile 148 are complementary to the valleys 112 of the cam's profile 108, while the valleys 152 of the cam follower's profile 148 are complementary to the peaks 110 of the cam's profile 108. Similarly, the ramped portions 154 of the cam follower's profile 148 are complementary to the ramped portions 114 of the cam's profile 108. Moreover, the amplitude $A_2$ and period $T_2$ of the cam follower's profile 148 are substantially equal to the amplitude $A_1$ and period $T_1$ of the cam's profile 108.

As can be seen in FIG. 12, the cam follower's profile 148 substantially matches the cam's profile 108 in an inverse manner. However, the profile 148 of the cam follower 94 may have alternative configurations in other embodiments that do not exactly match the profile 108 of the cam 92 but nonetheless can engage the profile 108 in a complementary manner. For instance, in some examples, the peaks 150 of the cam follower's profile 148 may be plateaued, while the corresponding valleys 112 of the cam's profile 108 are rounded. As another example, the valleys 152 of the cam follower's profile 148 may be rounded, while the corresponding peaks 110 of the cam's profile 108 are plateaued. As yet another example, the amplitudes $A_1$, $A_2$ of the profiles 108, 148 may be different from each other.

As discussed above, the rotating hinge body 74 is fixed to the shelf 38 and rotatably coupled to the stationary hinge body 72 such that the shelf 38 is rotatable with the rotating hinge body 74 relative to the stationary hinge body 72 between a first position and a second position. The cam assembly 90 can be configured such that when the shelf 38 and rotating hinge body 74 are in the first position, the cam surfaces 106, 146 of the cam 92 and cam follower 94 will face each other and the lobes 142 of the cam follower 94 will circumferentially align with the recesses 104 of the cam 92 about the axis X (see FIG. 8).

Moreover, the biasing member 96 is configured to bias the cam follower 94 such that the cam surfaces 106, 146 of the cam 92 and cam follower 94 will engage each other and the recesses 104 of the cam 92 will receive the lobes 142 of the cam follower 94 in the first position. More specifically, the biasing member 96 in the illustrated embodiment corresponds to a coil spring that can be provided around the shaft 120 of the cam follower 94 between the first wall member 128 and the second wall member 130 of the rotating hinge body 74 (see FIGS. 8 & 11). The coil spring 96 can be compressed by the first wall member 128 of the rotating hinge body 74 and the head 122 of the cam follower 94, thereby biasing the cam follower 94 along the axis X away from the first wall member 128 and into engagement with the cam 92.

As the shelf 38 is rotated from its first position toward the second position, the cam follower 94 will rotate with the rotating hinge body 74 relative to the stationary hinge body 72 and the cam 92. The lobes 102 of the cam 92 will then interfere with the lobes 142 of the cam follower 94 as the cam follower 94 rotates, which will cause the cam follower 94 to move axially away from the cam 92 (against the bias of the biasing member 96) to overcome the interfering lobes 102. This will generate a resistance to rotation of the shelf 38 that inhibits rotation of the shelf 38 from the first position.

In order to complete rotation of the shelf 38 from the first position to the second position, a user must provide enough rotational force on the shelf 38 to overcome the biasing force of the biasing member 96, so that the cam follower 94 can move axially away from the cam 92 a sufficient distance to rotate past the interfering lobes 102 of the cam 92. Once the shelf 38 is rotated far enough such that the lobes 142 of the cam follower 94 surpass the peaks of the lobes 102 on the cam 92, the biasing force exerted on the cam follower 94 by the biasing member 96 will cause the cam follower 94 and rotating hinge body 74 to keep rotating until the shelf 38 reaches its second position. In the second position, the lobes 142 of the cam follower 94 can again be circumferentially aligned with the recesses 104 of the cam 92 about the axis X (see FIG. 9).

The cam assembly 90 is thus designed to initially inhibit rotation of the shelf 38 out of the first position but then facilitate further rotation shelf 38 into the second position once the shelf 38 is rotated a sufficient amount for the lobes 142 of the cam follower 94 surpass the peaks of the lobes 102 on the cam 92.

The cam assembly 90 is similarly configured to inhibit rotation of the shelf 38 out of second position. More specifically, as the shelf 38 is rotated from its second position toward the first position, the cam follower 94 will rotate with the rotating hinge body 74 relative to the stationary hinge body 72 and the cam 92. The lobes 102 of the cam 92 will again interfere with the lobes 142 of the cam follower 94 as the cam follower 94 rotates, which will cause the cam follower 94 to move axially away from the cam 92 and against the bias of the biasing member 96. This will generate a resistance to rotation of the shelf 38 that inhibits rotation of the shelf 38 from the second position toward the first position.

In order to complete rotation of the shelf 38 from the second position to the first position, a user must provide enough rotational force on the shelf 38 to overcome the biasing force of the biasing member 96, so that the cam follower 94 can move axially away from the cam 92 a sufficient distance to rotate past the interfering lobes 102 of the cam 92. Once the shelf 38 is rotated far enough such that the lobes 142 of the cam follower 94 surpass the peaks of the lobes 102 on the cam 92, the biasing force exerted on the cam follower 94 by the biasing member 96 will cause the cam follower 94 and rotating hinge body 74 to keep rotating until the shelf 38 reaches its first position.

Figure 8:
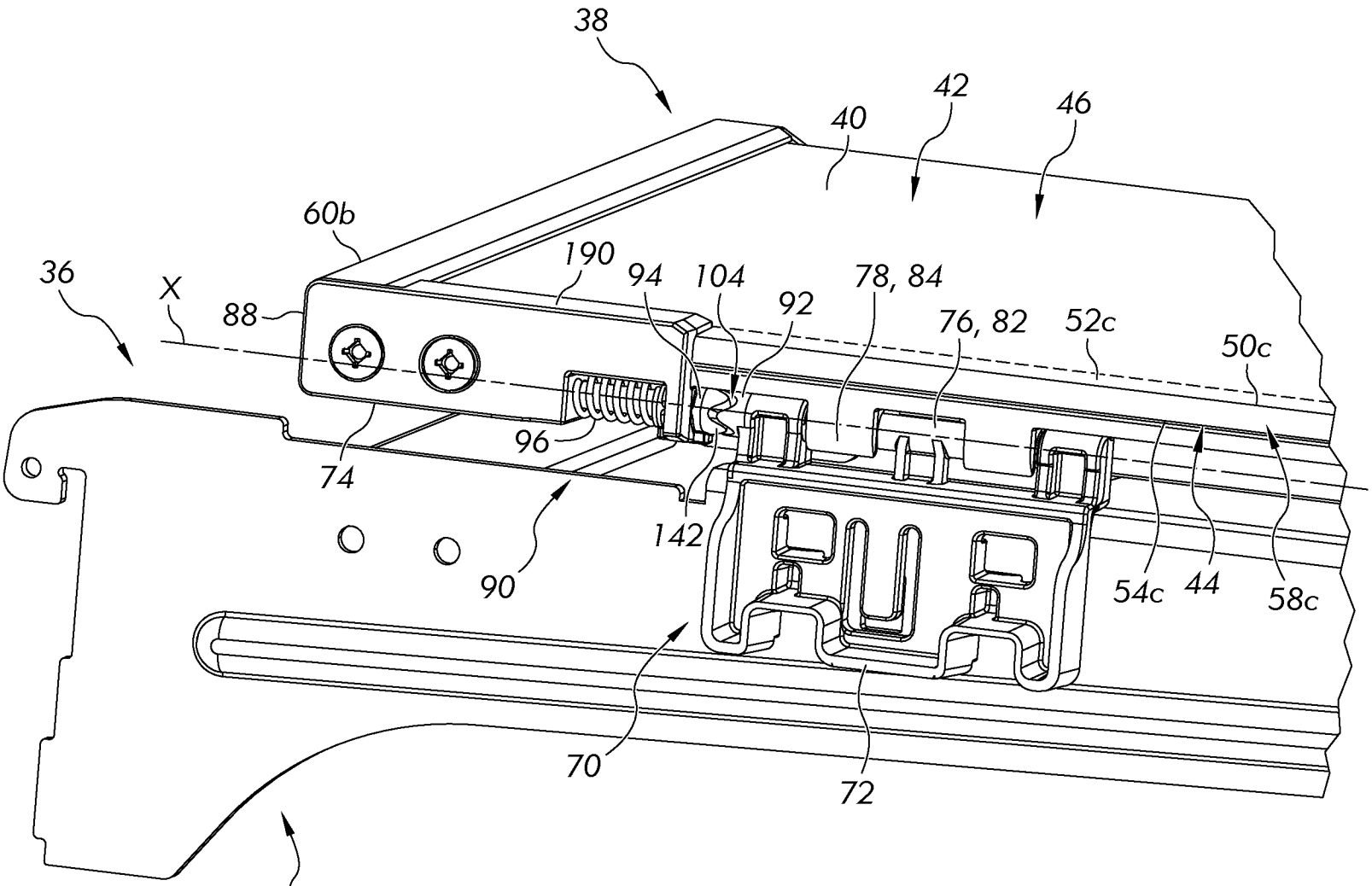
FIG. 8 is an enlarged perspective view of the shelf assembly, wherein the rotatable shelf is in the first position.
Figure 9:
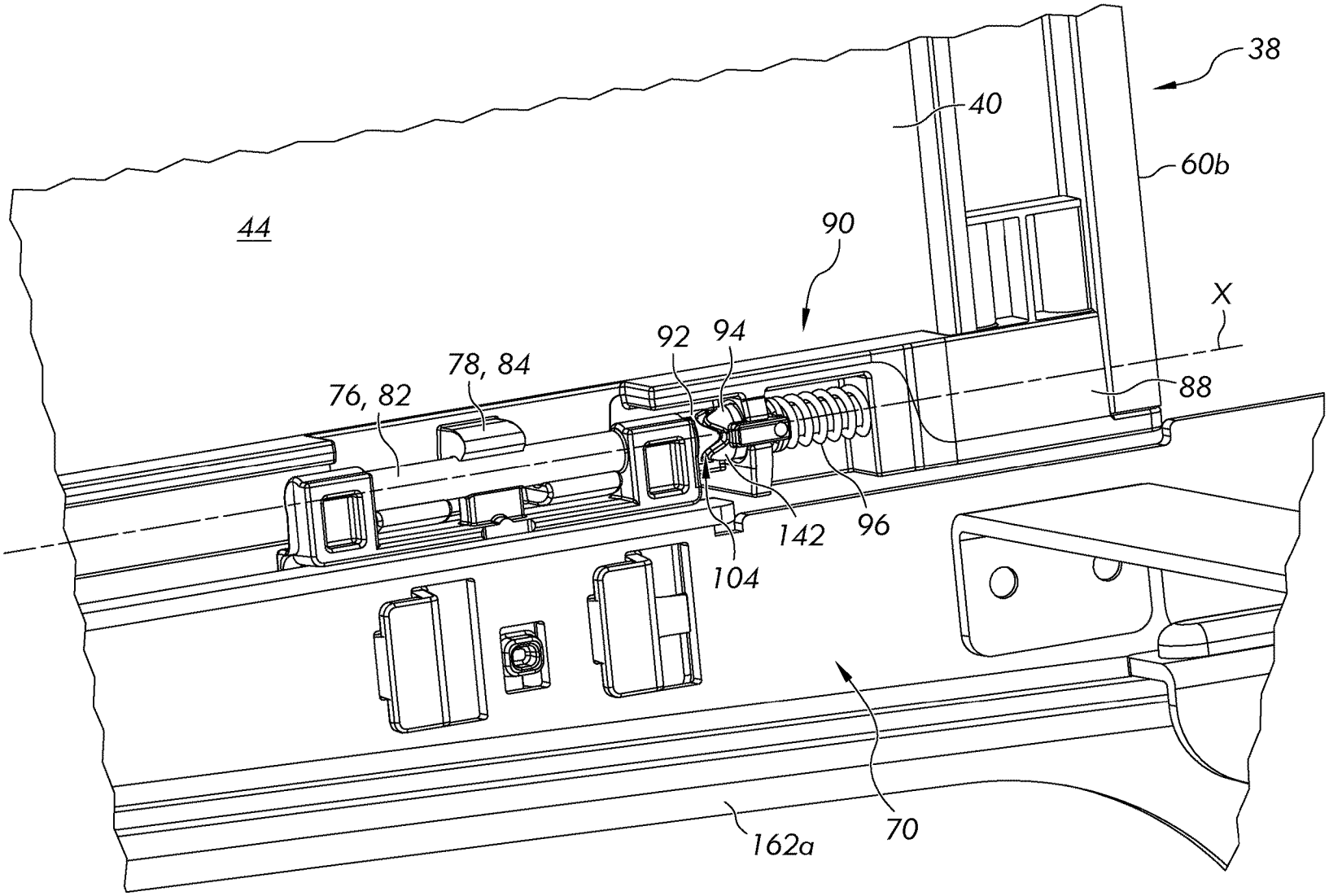
FIG. 9 is another enlarged perspective view of the shelf assembly, wherein the rotatable shelf is in the second position.

In the illustrated embodiment, the cam assembly 90 is designed such that when the shelf 38 is in either of its first and second positions, the lobes 142 of the cam follower 94 circumferentially align with the recesses 104 of the cam 92 about the axis X (see FIGS. 8 & 9). In this state, the shelf 38 will be at rest and the biasing member 96 will not encourage further rotation of the shelf 38 in any direction.

However, in other embodiments, the cam assembly 90 may be designed such that the lobes 142 of the cam follower 94 are not aligned with the recesses 104 of the cam 92 in the first and second positions, thereby maintaining a biasing force that encourages further rotation of the shelf 38 past the first and second positions. Such a design may be accomplished by, for example, providing the cam 92 with three lobes 102 spaced 120° apart from each other such that the period $T_1$ of its cam's profile 108 (i.e., 120°) is greater than the angle of rotation between the first and second positions (e.g., 90°). In such an example, the appliance 10 can be provided with one or more stopping members (e.g., brackets, supports, etc.) that prohibit further rotation of the shelf 38 past its first and second positions. In this manner, a biasing force can be maintained on the shelf 38 in its first and second positions that presses the shelf 38 against the stopping member(s) and holds the shelf 38 in place.

The cam assembly 90 in the illustrated embodiment can be referred to as an axial cam assembly, since the cam follower 94 moves and is biased axially with respect to the rotational axis X of the hinge assembly 70. However, the cam assembly 90 may comprise a radial configuration in other examples wherein a cam follower moves and is biased radially with respect to the axis of rotation. The cam assembly 90 can comprise any configuration in which a moveable cam follower is biased into engagement with a cam and inhibits rotation of the shelf 38 from its first and/or second positions.

Additional features will now be described that can provide support and/or added stability to the rotating shelf 38. For instance, as shown in FIG. 4, the shelf assembly 36 can include a support unit 160 for coupling the shelf 38 to the inner liner 14 of the cabinet 12.

The support unit 160 comprises one or more arms 162 that can be coupled to a wall (e.g., the rear wall 18*b*, the left wall 18*c*, the right wall 18*d*, etc.) of the inner liner 14 such that the arms 162 are cantilevered from the wall. For instance, the support unit 160 can include a first arm 162*a* and a second arm 162*b* that is spaced from and extends substantially parallel to the first arm 162*a*. Each arm 162 can include one or more hooks 164 that can be inserted into an associated aperture 166 defined by the wall (e.g., rear wall 18*b*) of the inner liner 14 to couple the arm 162 to the wall. Moreover, in some examples, the support unit 160 can include a support bracket 170 that extends substantially perpendicular to the first and second arms 162*a*, 162*b* and is connected at one end to the first arm 162*a* and at another end to the second arm 162*b*. In this manner, the support bracket 170 can provide structural support to the first and second arms 162*a*, 162*b* for added stability.

Each stationary hinge body 72 of the shelf assembly 36 can be fixed to (e.g., integrally formed with or separately attached to) an arm 162 of the support unit 160 such that the shelf 38 is supported by the arm 162 and the rotational axis X of the shelf 38 is adjacent and extends parallel to the arm 162. Meanwhile, the other arm 162 of the support unit 160 can comprise a resting surface 168 that the shelf 38 will contact (either directly or indirectly) and rest on when the shelf 38 is in the first position.

The support unit 160 can have a variety of different configurations for indirectly coupling the shelf 38 to the inner liner 14. For instance, in some examples, the support unit 160 may not comprise the support bracket 170 described above. Rather, the first and second arms 162*a*, 162*b* may be independent from each other and separately coupled to the inner liner 14. Moreover, in some examples, the support unit 160 may simply comprise a single arm 162 (e.g., first arm 162*a*) that each stationary hinge body 72 of the shelf assembly 36 is fixed to.

In some examples, the shelf assembly 36 can include a support bracket that connects two or more trim members 60 of the rotating shelf 38 to provide added rigidity to the shelf 38. For instance, as shown in FIG. 4, the shelf assembly 36 can include a support bracket 180 that is fixed at one end to the front trim member 60*a* and fixed at another end to the rear trim member 60*b*. In the illustrated embodiment, the support bracket 180 is fixed to the front and rear trim members 60*a*, 60*b* such that the support bracket 180 is disposed on a right side of the glass panel 40 and extends along the right side surface 58*d* of the glass panel 40. Moreover, the support bracket 180 includes a contact surface 182 that is configured to contact and rest upon the resting surface 168 of the support unit 160 described above when the shelf 38 is in the first position. The support bracket 180 can be fixed to the front and rear trim members 60*a*, 60*b* using one or more fastening elements (e.g., screws, clips, adhesive, etc.) or by forming the support bracket 180 integrally with the front and rear trim members 60*a*, 60*b*.

In some examples, the shelf assembly 36 can include a stability bracket 190 (see FIG. 3) that is fixed to (e.g., integrally formed with or separately attached to) the rotating hinge body 74 of the hinge assembly 70 such that the stability bracket 190 extends along the hinge body's associated edge 50 (e.g., left edge 50*c*) over the upper side 46 of the glass panel 40 (e.g., between the rear edge portion 52*b* and the left edge portion 52*c*). This stability bracket 190 can provide added rigidity to the glass panel 40 during rotation of the shelf 38. Preferably, however, the stability bracket 190 should only extend along a minor length of its associated edge 50 (see e.g., FIG. 3) to maximize the length of any exposed edge portions 52 along the edge 50. For the purposes of this disclosure, reference to a "minor length" of an edge means less than 50% of the edge's length, preferably, 25% or less of the edge's length, and more preferably, 15% or less of the edge's length.

Figure 13:
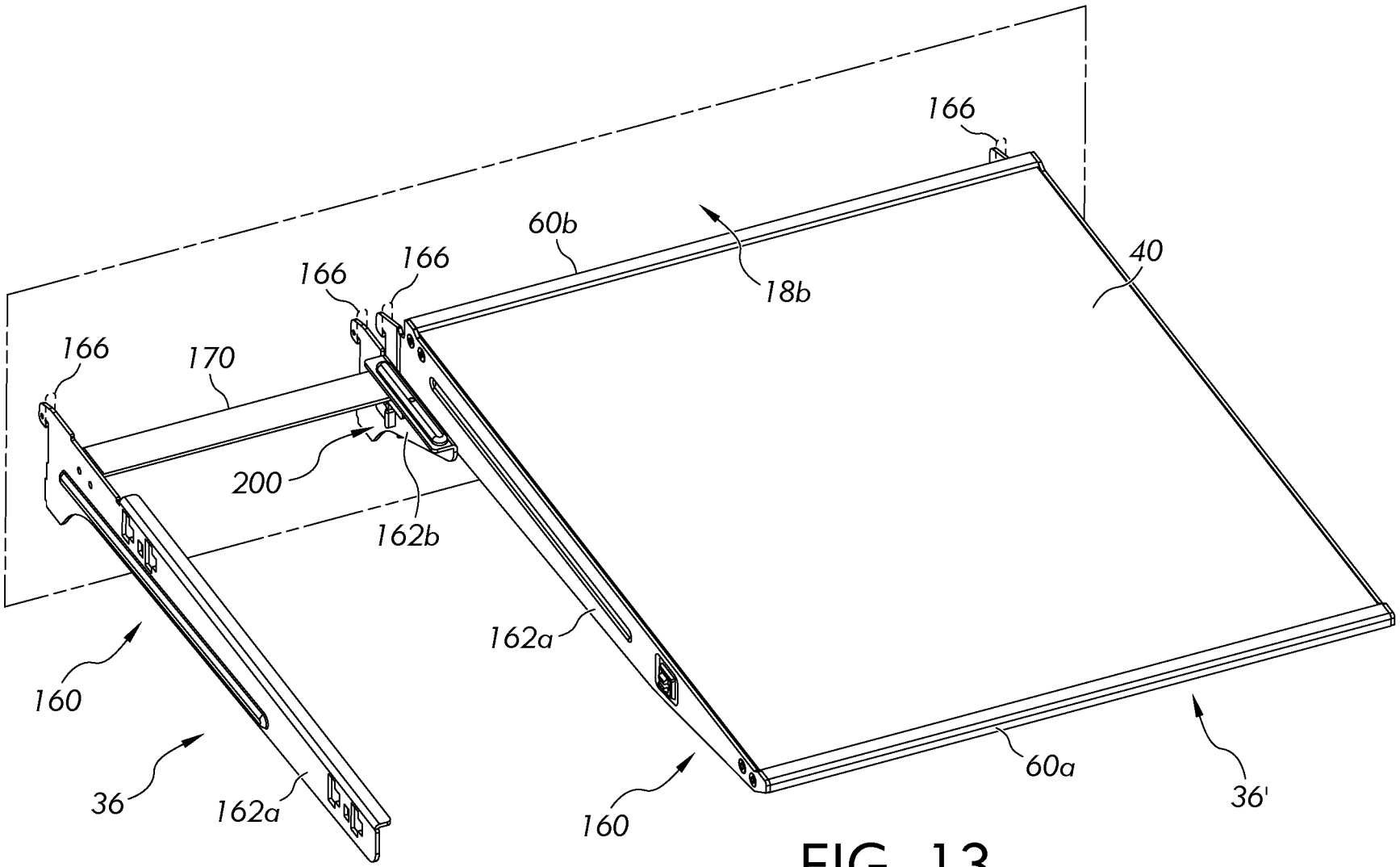
FIG. 13 is a perspective view of a second shelf assembly coupled to a support unit of the shelf assembly illustrated in FIGS. 3-12.
Figure 14:
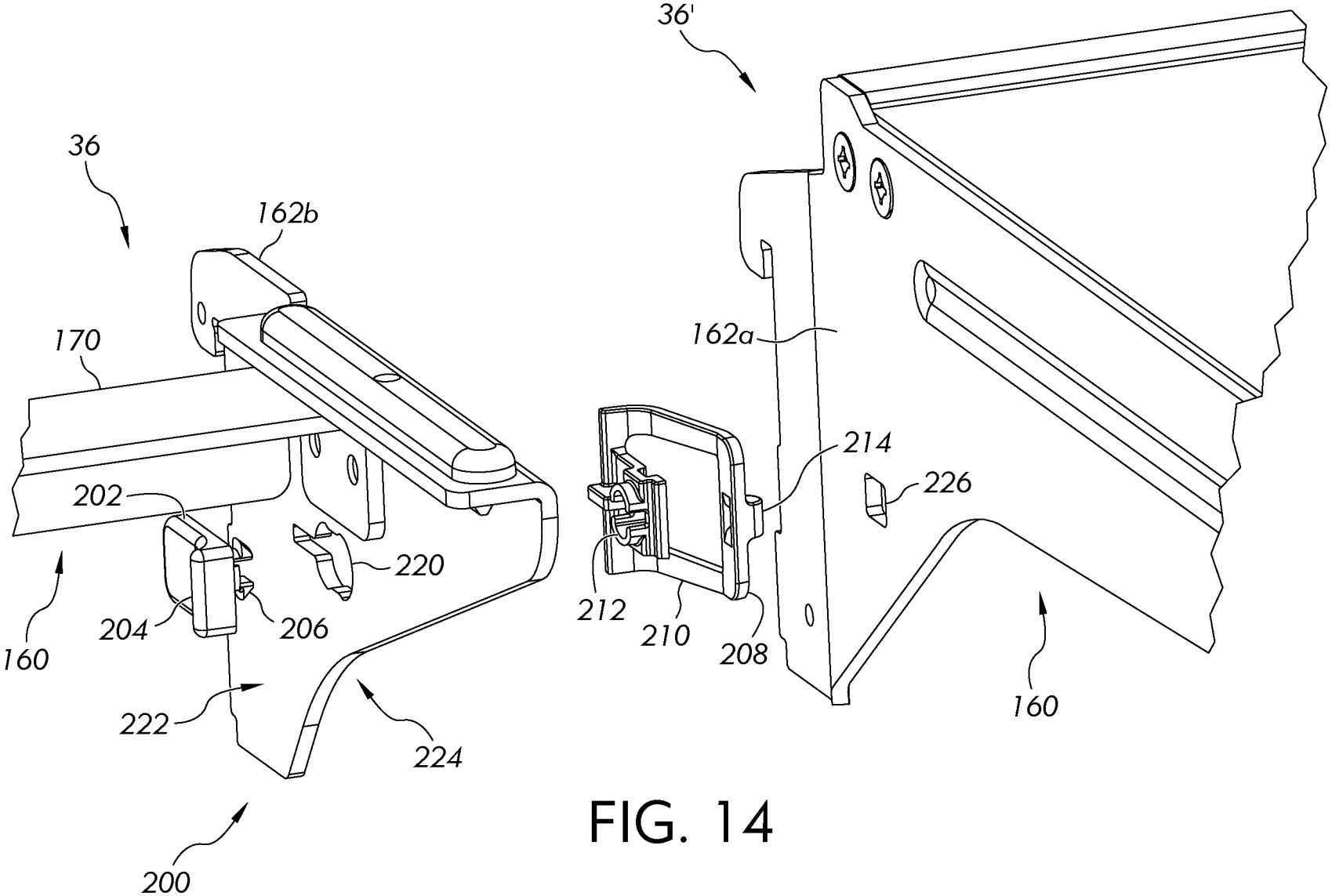
FIG. 14 is an exploded view of a coupling between the two shelf assemblies illustrated in FIG. 13.

In some examples, the shelf assembly 36 can be coupled to an adjacent shelf assembly to prohibit relative movement between the two assemblies and thereby add stability to both assemblies. For example, as shown in FIGS. 13 & 14, the appliance 10 can include a second shelf assembly 36' adjacent to the first shelf assembly 36 described above. For ease of illustration, only the support unit 160 of the first shelf assembly 36 is shown in FIGS. 13 & 14.

The second shelf assembly 36' can be configured similar to the first shelf assembly 36 described above. For instance, the second shelf assembly 36' in the illustrated embodiment similarly includes a glass panel 40, front and rear trim members 60*a*, 60*b*, and a support unit 160 as described above. Alternatively, the second shelf assembly 36' could have a different construction.

A coupling mechanism 200 (best seen in FIG. 14) can be provided that couples the support unit 160 of the first shelf assembly 36 to the support unit 160 of the second shelf assembly 36'. The coupling mechanism 200 includes a first coupling member 202 having a first main body 204 and a first latching portion 206 that projects from the first main body 204. The coupling mechanism 200 further includes a second coupling member 208 having a second main body 210, a second latching portion 212, and a projection 214 that projects from the second main body 210.

To install the coupling mechanism 200, the first latching portion 206 of the first coupling member 202 can be inserted through an aperture 220 in an arm 162 (e.g., second arm 162*a*) of the first shelf assembly 36 such that the first main body 204 of the first coupling member 202 is disposed on a first side 222 of the arm 162. Meanwhile, the second coupling member 208 can be disposed on a second side 224 of the arm 162 and latched to the first coupling member 202 by connecting, through the aperture 220, the first and second latching portions 206, 212 of the first and second coupling members 202, 208.

The appliance 10 is designed such that when the first and second shelf assemblies 36, 36' are arranged adjacent to each other and the coupling mechanism 200 is installed as described above, the projection 214 of the coupling mechanism 200 will be received within a corresponding receiving portion 226 (e.g., aperture) in the support unit 160 of the second shelf assembly 36'. When engaged, this mating of the projection 214 and receiving portion 226 will effectively prohibit relative movement between the support units 160 of the first and second shelf assemblies 36, 36', thereby adding stability to both support units. Indeed, the support unit 160 of the first shelf assembly 36 as coupled will not be able to move up or down unless the support unit 160 of the second shelf assembly 36' is also moved.

In a further embodiment, the first and second coupling members 202, 208 can be designed to assist the manufacturing process. For example, the aperture 220 can have an oblong shape that permits the first and second latching portions 206, 212 to linearly slide therein. Thus, during manufacturing assembly, the first and second coupling members 202, 208 can be attached to the support unit 160 via the aperture 220, and thereafter the first and second shelf assemblies 36, 36' can be separately installed into the refrigerator compartment. The projection 214 will be misaligned from and not engaged with the receiving portion 226. Lastly, the first and second coupling members 202, 208 can linearly slide within the aperture (e.g., backwards or into the page as shown in FIG. 14) until the projection 214 is aligned with and lockingly engaged with the receiving portion 226 to thereby effectively prohibit relative movement between the support units 160 of the first and second shelf assemblies 36, 36'. Optionally, the distance between the adjacent support units 160 may be less than the width of the second coupling member 208 so that the second main body 210 may be flexible and operate as a leaf spring, such as via a living hinge, to resiliently bias the projection 214 towards the receiving portion 226.

The features of the shelf assemblies 36, 36' described above can comprise a variety of different materials/compositions and can be formed using a variety of different methods. For example, as discussed above, the panel 40 can comprise a glass material and can be opaque, translucent, or transparent. As another example, the stationary and rotating hinge bodies 72, 74 described above can each be a monolithic structure comprising stamped sheet metal or metal that has been molded in a die-casting process. Likewise, the component(s) of the support unit 160 described above (e.g., the first and second arms 162*a*, 162*b* and the support bracket 170) can comprise stamped sheet metal. As yet another example, the trim members 60 described above can each be a monolithic structure comprising plastic that has been extrusion or injection molded. However, these features can comprise alternative materials/compositions and can be formed using alternative methods in other embodiments.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims and their equivalents.

What is claimed is:

1. A shelf assembly comprising:

a stationary hinge body;

a rotating hinge body rotatably coupled to the stationary hinge body; and a shelf fixed to the rotating hinge body that is rotatable with the rotating hinge body relative to the stationary hinge body about a rotational axis, the shelf being rotatable between a first position and a second position, wherein the shelf comprises a glass panel having an upper surface and a lower surface, the upper surface comprising a plurality of edge portions, and wherein at least one of the plurality of edge portions of the upper surface is exposed.

2. The shelf assembly according to claim 1, further comprising a cam assembly configured to inhibit rotation of the shelf between its first position and second position, the cam assembly including:

a cam that is fixed to one of the stationary hinge body and rotating hinge body;

a cam follower movably attached to the other of the stationary hinge body and rotating hinge body, and a biasing member that biases the cam follower into engagement with the cam.

3. The shelf assembly according to claim 2, wherein the cam follower is slidingly coupled to the other of the stationary hinge body and rotating hinge body such that the cam follower is slidable along the rotational axis.

4. The shelf assembly according to claim 3, wherein the biasing member biases the cam follower along the rotational axis into engagement with the cam.

5. The shelf assembly according to claim 2, wherein the cam is fixed to the stationary hinge body and cam follower is slidingly coupled to the rotating hinge body such that the cam follower is slidable relative to the rotating hinge body along the rotational axis.

6. The shelf assembly according to claim 5, wherein the cam follower is configured to prohibit rotation of the cam follower relative to the rotating hinge body about the rotational axis.

7. The shelf assembly according to claim 2, wherein the cam and cam follower each include:

a plurality of lobes that are symmetrically spaced about the rotational axis and project axially from a base body; and a plurality of recesses defined between the plurality of lobes that are symmetrically spaced about the rotational axis.

8. The shelf assembly according to claim 7, wherein the cam assembly is configured such that when the shelf is in the first position, the plurality of lobes of the cam follower will circumferentially align with the plurality of recesses of the cam about the rotational axis.

9. The shelf assembly according to claim 8, wherein the cam assembly is configured such that when the shelf is in the second position, the plurality of lobes of the cam follower will circumferentially align with the plurality of recesses of the cam about the rotational axis.

10. The shelf assembly according to claim 2, wherein:

the cam follower comprises a shaft that is coaxial with the rotational axis, and the biasing member comprises a coil spring that is provided around the shaft of the cam follower.

11. The shelf assembly according to claim 10, wherein the coil spring is compressed by a head of the cam follower and a wall member of the rotating hinge body such that the coil spring biases the cam follower along the rotational axis into engagement with the cam.

12. The shelf assembly according to claim 1, wherein:

the plurality of edge portions of the upper surface includes a front edge portion, a rear edge portion, a left edge portion, and a right edge portion; and the left edge portion and the right edge portion are exposed.

13. The shelf assembly according to claim 12, wherein:

the shelf comprises a front trim member and a rear trim member attached to the glass panel, the front trim member extends longitudinally along and a front side surface of the glass panel, and the rear trim member extends longitudinally along a rear side surface of the glass panel.

14. The shelf assembly according to claim 13, wherein the front trim member extends longitudinally along the entire front side surface of the glass panel and the rear trim member extends longitudinally along the entire rear side surface of the glass panel.

15. The shelf assembly according to claim 14, wherein the front trim member covers the front edge portion of the glass panel and the rear trim member covers the rear edge portion of the glass panel.

16. The shelf assembly according to claim 15, wherein:

the left edge portion of the glass panel extends continuously along a major length of an associated left edge of the glass panel; and the right edge portion of the glass panel extends continuously along a major length of an associated right edge of the glass panel.

17. The shelf assembly according to claim 16, wherein the right edge portion of the glass panel extends continuously along the associated right edge of the glass panel from the front edge portion to the rear edge portion.

18. The shelf assembly according to claim 13, wherein the rotating hinge body is fixed at one end to the front trim member and at another end to the rear trim member.

19. The shelf assembly according to claim 18, wherein:

the upper surface of the glass panel defines an upper side of the glass panel and the lower surface of the glass panel defines a lower side of the glass panel; and the rotating hinge body is disposed on the lower side of the glass panel.

20. A shelf assembly comprising:

a first support unit;

a stationary hinge body fixed to the first support unit;

a rotating hinge body rotatably coupled to the stationary hinge body;

a first shelf fixed to the rotating hinge body that is rotatable with the rotating hinge body relative to the stationary hinge body about a rotational axis, the first shelf being rotatable between a first position and a second position;

a second support unit that is separate from the first support unit;

a second shelf coupled to the second support unit; and a coupling mechanism that couples the first support unit and second support unit to each other to inhibit relative movement between the first support unit and second support unit, wherein the first shelf comprises a glass panel having an upper surface and a lower surface, the upper surface comprising a plurality of edge portions, and wherein at least one of the plurality of edge portions of the upper surface is exposed.

* * * * *